United States Patent [19]

Ragoza et al.

[11] 4,270,368

[45] Jun. 2, 1981

[54] METHOD AND CIRCULAR WARP KNITTING MACHINE FOR KNITTING STOCKINGS

[76] Inventors: Igor V. Ragoza, Moskovsky prospekt, 7, kv. 114; Petr M. Begunov, ulitsa Shirokaya, 30, kv. 5; Petr J. Vasiljuk, ulitsa Chkalova, 11, korpus 12, kv. 79; Dina N. Tonikian; Robert T. Tonikian, both of ulitsa Chkalova, 11, korpus 10, kv. 92, all of Vitebsk, U.S.S.R.

[21] Appl. No.: 72,102

[22] Filed: Sep. 4, 1979

[51] Int. Cl.[3] ..... D04B 9/44; D04B 9/12; D04B 9/14; D04B 9/16

[52] U.S. Cl. ..... 66/13; 66/81; 66/8

[58] Field of Search ..... 66/7, 8, 10, 13, 135, 66/178, 185, 187, 81

[56] References Cited

U.S. PATENT DOCUMENTS

| | | | |
|---|---|---|---|
| 732,433 | 6/1903 | Nicholls | 66/10 |
| 732,434 | 6/1903 | Nicholls | 66/10 |
| 1,998,473 | 4/1935 | Welch et al. | 66/8 |
| 2,312,965 | 3/1943 | Guyler et al. | 66/8 |
| 3,570,268 | 3/1971 | Nogues | 66/135 X |

*Primary Examiner*—Ronald Feldbaum
*Attorney, Agent, or Firm*—Steinberg & Raskin

[57] ABSTRACT

The method for knitting stockings comprises laying two systems of warp threads on knitting needles by means of two sets of guide needles and knitting a continuous hose which consists of a plurality of serially arranged stockings. Each stocking is made by knitting, in a sequence, with one-bar tricot stitch from one system of warp threads, an overturned welt 6 of the stocking and with two-bar tricot stitch from the two systems of warp threads, a leg, a heel portion, a sole portion and pull courses. After knitting the pull courses of the stocking, a garterband portion is knit with the loop length which is at least equal to the loop length of a cylindrical portion of the leg. In addition, at least two courses are knit with one-bar tricot stitch from one system of warp threads between the sole portion and the pull courses and between the pull courses and the garterband portion 5, respectively, to form boundary portions of the stocking thereby defining the length of the stocking and marking the point at which the hose is cut into individual stockings. A circular warp knitting machine used to carry out the method according to the invention, in addition to main stitch forming mechanisms, has stop motions of these mechanisms kinematically coupled to a control drum of the control device of the machine so that desired mechanisms might be disengaged and reengaged in accordance with the method for knitting stockings to knit various portions of the stocking with either one-bar tricot stitch or two-bar tricot stitch.

12 Claims, 18 Drawing Figures

METHOD AND CIRCULAR WARP KNITTING MACHINE FOR KNITTING STOCKINGS

The invention relates to the knitwear manufacture, and more particularly, to method and circular warp knitting machine for knitting stockings (stockings, knee-length stockings and the like).

Known in the art is a method for knitting stockings produced in the form of a continuous hose on an automatic two-cylinder sinker stocking knitting machine (cf. I. I. Shatalov, K. D. Mikhailov, Machines and Manufacturing Techniques of Circular Warp Knit Stockings, in Russian, Moscow, 1968). In accordance with this method, a continuous hose is formed of a plurality of serially arranged stockings of given length, each having a welt, a top cylindrical leg portion, an instep, a heel, a sole, a tubular toe including pull courses and a separating course. The provision of the separating course facilitates the separation of one stocking from another, the cutting being effected across the course preceding the first course of the welt.

The perimeter of the portion of a stocking and loop length are changed without inertia and time losses by changing the sinking depth.

This method of knitting cannot, however, be used for making stockings on a circular warp knitting machine since the stocking should have a portion enabling the protection of first courses of the welt against unraving. Furthermore, in order to switch over from knitting a narrow tubular toe to knitting of the wide welt of a stocking, the loop length cannot be changed abruptly since it is not possible to change the loop length without inertia upon the command from the control device of the machine.

Known in the art is another method for knitting stockings on a circular warp knitting machine (cf. USSR Inventor's Certificate No. 360418), comprising laying on knitting needles (such as flap needles) two systems of warp threads by means of two sets of guide needles moving along the front of and between the knitting needles, and knitting, under the action of a general draw-off force, a continuous hose with two-bar tricot stitch. In accordance with this method, after knitting a given length of a stocking, a curved portion is knit (such as a heel of a stocking) by knitting at regular intervals after every one or several courses additional courses on a portion of the knitting needles.

This method does not, however, provide any visual marks during the knitting of a stocking for rapid and accurate separation of one piece from another, nor any intermediate portions facilitating the sewing-up the tubular toe of the stocking.

Known in the art is also a method for knitting a welt of stockings on a circular warp knitting machine (cf. USSR Inventor's Certificate No. 388067, Cl. DO4B 25/14). In accordance with this method, the welt is knit with one-bar tricot stitch, while the stocking itself is knit with two-bar tricot stitch, one of the sets of guide needles being kept stationary during the welt knitting, and warp threads passing through the stationary set of guide needles are tensioned so that the first course of the welt is held on the knitting needles in the immediate vicinity of any next course being knit, whereby the welt is overturned concurrently with the knitting thereof, the draw-off mechanism being disengaged. The welt is sewed-up during the knitting of the first course of the leg by re-engaging the set of guide needles which have been disengaged beforehands and by laying two systems of warp threads on the knitting needles.

However, during the knitting of the welt and its concurrent overturning, the general draw-off force applied to the stocking should be removed. As a result, the welt loops knocked-over from the knitting needles are shortened under the action of tensioning of warp threads of the engaged set of guide needles, owing to the overdrawing of thread into new loops being sunk on the needles. All this reduces extensibility of the welt and impairs quality of the stockings being manufactured.

The methods for knitting stockings disclosed in USSR Inventor's Certificate Nos. 360418, 388067 are carried out on a circular warp knitting machine comprising a needle cylinder having movable knitting needles and sinkers, two sets of guide needles which are caused to move between the knitting needles by means of a rocking mechanism and installed in two concentrically arranged annular guide bars which are caused to move along the front of the knittng needles by means of racking mechanisms, whereby a stocking is knit with two-bar tricot stitch. For knitting the welt portion with one-bar tricot stitch, one of the racking mechanisms is adapted to disengage its guide bar. In addition, the machine has mechanisms for positive feed of warp threads of each system having a spring-biased rest, a draw-off mechanism and a control device of the machine including a control drum.

It is an object of the invention to provide a method for knitting stockings enabling the formation of the welt which is run-proof and exhibits desired extensibility.

Another object of the invention is to provide a method for knitting stockings which enables rapid and easy cutting of the hose into individual stockings and provides maximum convenience in sewing-up the tubular toe of the stocking.

Still another object of the invention is to provide a circular warp knitting machine which enables knitting of stockings with a run-proof welt having desired extensibility.

With these and other objects in view in a method for knitting stockings on a circular warp knitting machine, comprising laying two systems of warp threads on knitting needles by means of two sets of guide needles which are caused to move along the front of and between the knitting needles and knitting, under the action of a general draw-off force, a continuous hose consisting of a plurality of serially arranged stockings of given length, each being produced by knitting, in a sequence, an overturned welt of a stocking with one-bar tricot stitch fom one system of warp threads and cylindrical portion of the leg, tapering portion, instep, heel portion, sole with tubular toe and pull courses with two-bar tricot stitch from the two systems of warp threads, with subsequent cutting of the continuous hose into individual stockings and closure of the toe in each stocking by a known per se method, according to the invention, after the pull courses of the stockings are knit, a garterband portion is knit from two systems of warp threads with two-bar tricot stitch with the loop length at least equal to the loop length of the cylindrical portion of the leg, and at least two courses are knit between the sole portion and the pull courses and between the pull courses and the garterband portion, respectively, with one-bar tricot stitch from one system of warp threads to form boundary portions of the tubular toe and pull courses, respectively, the action of the general draw-off force and the feed of warp threads of the second system to the stitch forming zone being maintained in knittng the welt and the boundary portions of the stocking with one-bar tricot stitch from one system of warp threads, and continuous hose is cut into individual stockings across the boundary portions.

Knitting the garterband portion with a loop length at least equal to the loop length of the cylindrical portion of the leg ensures good extensibility of the garterband portion and eliminates pressure in wear since the graterband portion is retained in the finished stocking. The provision of this portion protects the welt in the sewing zone from unraving.

The provision of boundary portions (marks) of pull courses and tubular toe facilitates the cutting of the hose into individual stockings and visualizes the toe boundary in sewing-up the toe.

Maintaining the draw-off force and feed of warp threads in the disengaged set of guide needles in knitting the welt and the boundary portions simplifies the machine structure in general and does not require deceleration of the entire machine, whereby the productivity of the equipment on the whole is improved.

Knitting the welt under the action of the general draw-off force enables longer loops to be obtained which is necessary to ensure a desired extensibility of the welt and eliminates excessive pressure on the leg.

According to the method of the invention, in knitting the welt of a stoking from one system of warp threads, the rate of feed of warp threads of the second system is adjusted to be equal to the rate of knitting of the welt, and after a given length of the welt is knit, the general draw-off force is removed, warp threads of the second system are drawn-off in the direction opposite to their feed thereby bringing the first course of the welt to the ultimate course thereof to overturn the welt, whereafter the general draw-off force is applied to the stocking, and the welt is sewed up by laying warp threads of both systsms on the knitting needles together to form the first course of the leg, all stitch forming members being disengaged during the overturning of the welt. This makes it possible to knit the welt under the action of the general draw-off force and to obtain a desired extensibility of the welt, and the subsequent drawing-off of the warp threads of the disengaged system provides for good overturning of the welt and does not complicate the construction of the machine to the extent similar to the use of sewing hooks of automatic single-cylinder circular sinker stocking knitting machines or overknitting and welt hooks in Cotton machines.

Concurrently with the transition switch-over for the knitting of pull courses of a stocking, the rate of feed of warp threads in both systems is preferably increased to stitch the loops of the pull courses at a length equal to the loop length of the garterband portion. This facilitates the preparation of the machine for knitting with longer loops the garteband portion during the period of knitting the pull courses, because any change in the loop length takes a certain time in warp knitting machines.

The method for knitting stockings according to the invention is carried out on a circular warp knitting machine comprising a needle cylinder having movable knitting needles and sinkers, two sets of guide needles which are caused to move between the knitting needles by a rocking mechanism and installed in two concentrically arranged annular guide bars which are caused to move along the front of the knitting needles by means of racking mechanisms of which one is adapted to disengage its guide bar in knitting the welt of a stocking with one-bar tricot stitch, mechansims for positive feed of warp thread of each system having a spring-biased rest, a draw- off mechanism and a control drum of a control device of the machine. According to the invention, the machine of the above-described type has a stop motion of a main shaft controlling the movement of stitch forming members for their disengagement during the overturning of the welt and individual stop motions of the racking mechanism and the rocking mechanism of one of the sets of guide needles and of the mechanism for positive feed od warp threads passing through the set of guide needles which is disengaged to knit portions of the stocking with one-bar tricot stitch from warp threads passing through the other set of guide needles, the motions being controlled by the control drum through a kinematic chain, further, the draw-off mechanism is provided with a device for spacing apart the rolls thereof and for steplessly controlling their urging force, and each mechanism for positive feed of warp threads is provided with a device for steplessly controlling the rate of feed of warp threads, the device being also kinematically coupled to the control drum, the mechanism for positive feed of warp threads passing through the set of guide needles which are disengaged being provided with an additional spring-biased rest, the main spring-biased rest of the mechanism being retractile from the zone of engagement thereof with warp threads.

The provision in the machine of the device for steplessly controlling the rate of feed of threads ensures a stepless variation of the length of loops as the hose is knit, hence a stepless change in the diameter of each stocking, e.g. at the tapering portion.

The device for spacing apart the rolls of the draw-off mechanism and for steplessly controlling their urging force cooperates with the device for steplessly controlling the rate of feed of warp threads and also contributes to the stepless change in diameter of the stocking being knit, e.g. at the tapering portion.

The provision of the stop motion of the mechanism for positive feed of warp threads of the set of guide needles which is disengaged provides desired conditions for knitting the welt with one-bar tricot stitch from warp threads of the other system and eliminates the feed of superfluous warp threads from the disengaged system into the stitch forming zone in knitting the welt.

The main spring-biased rest which is retracted from the zone of engagement of the warp threads does not hamper the feed of the warp threads of the disengaged system controllable thereby to the stitch forming zone in knitting the welt. When engaged, the main rest ensures the overturning of the welt.

The additional rest maintains the warp threads passing through the set of guide needles which is disengaged under minimum tension which prevents these threads from sagging, does not hamper the general draw-off force application and ensures the feed of the warp threads of the disengaged system to the zone of the welt knitting with the disengaged mechanism for positive feed of these warp threads.

The device for spacing apart the rolls of the draw-off mechanism ensures the removal of the draw-off force, acting on the hose being knit, during the overturning of the welt when the entire hose is drawn towards the stitch forming zone.

The stop motion of the main shaft which transmits motion to stitch forming members (knitting needles, sinkers, racking and rocking mechanisms of both sets of guide needles and mechanisms for positive feed of warp threads) ensures the stoppage and locking of these mechanisms in a given position for a time determined by the control device of the machine, for overturning the welt of a stocking. This stop motion causes all these mechanisms to stop and does not require individual stop motions for each of these mechanisms so that the overall structure of the machine becomes simpler.

According to the invention, the stop motion for stopping the rocking mechanism of one set of guide needles comprises a sleeve which has a member imparting motion to the rocking mechanism and is loosely mounted on the drive shaft of the machine, and a cam clutch having a drive member secured to the drive shaft of the machine, a braking member secured to the frame of the machine coaxially with the drive shaft, and a double-action driven member mounted on the sleeve by means of a sliding key for moving along the sleeve and for alternately engaging the drive member and the braking member, the kinematic chain coupling the stop motion of the rocking mechanism to the control drum including a fork lever embracing the driven member and pivotally secured to the machine frame, and two telescoping rods urged by a spring against one another, one rod being connected to the fork lever and the other biased by a spring against the frame and coupled by means of intermediate links to the control drum. This arrangement ensures a reliable disengagement and locking of the guide bar in a pre-set position and does not require any special accuracy of the control device as regards the moment of feeding of the command for switching over the stop motion thus simplifying the operation and structure of the machine. In addition, the provision of this arrangement eliminates the rocking motion of the guide needles of the disengaged system of warp threads in knitting the welt and the boundary portions of a stocking thus preventing the warp threads from being worn in the eyelets of the guide needles.

The invention is characterized in that the stop motion of the racking mechanism comprises a spring-biased ring kinematically coupled to the control drum and having a boss on the peripheral surface thereof and an arm, the ring being rotatable on a rotary plate of a drive shaft of the racking mechanism having a profiled cam, and a roller biased by a spring thereagainst and secured to a double-arm lever which is linked by a drawbar to the guide bar, the radius of the outer surface of the boss of the rotatable ring being equal to maximum radius of the profiled cam, and upon rotation of the ring, the boss is brought beneath the roller to keep it retracted from the profiled cam.

Therefore, the stop motion of the racking mechanism of the guide needles ensures the disengagement of warp threads of a given system for knitting the welt and the boundary portions. The stop motion is integrally built in the racking mechanism of the guide bar and participates in the transmission of the racking motion to the guide bar.

The invention is also characterized in that the additional spring-biased rest is installed immdiately adjacent to the main rest on one and the same axle therewith, the main rest being connected by its leaf spring to a spring-biased frame which has arms acting on the main rest upon rotation of the frame, the frame being installed in the axle of both rests and connected to the control drum by means of a system of levers.

The additional rest ensures the feed of warp threads to the stitch forming zone owing to its lowering under the action of thread tensioning and change in their configuration in space.

The device for steplessly controlling the rate of feed of warp threads preferably comprises an eccentric mounted on the drive shaft and linked to an arm mounted in the frame, a spring-biased slider mounted on the arm by means of a sliding key and kinematically coupled to the control drum and to the device controlling the change in the rate of feed of warp threads in accordance with a given program, and two overriding clutches angularly displaced relative to one another at 180°, which are linked by means of drawbars to the slider and installed on an intermediate shaft kinematically coupled to shafts of drive rubber-lined rolls of the mechanism for positive feed of warp threads, the shafts of the drive rubber-lined rolls being connected to the rolls by means of the stop motion thereof.

This arrangement of the device for steplessly controlling the rate of feed of warp threads enables both stepless or stepwise variation of the rate of feed of the threads, it exhibits a low inertia upon stoppage of the machine and ensures an adequate uniformity of feed of warp threads ensuring good unifromity of the stitch pattern of a stocking.

The invention is also characterized in that the stop motion for stopping the mechanism for positive feed of warp threads comprises, for drive rubber-lined roll, a fine-tooth clutch having a driven member secured to the drive rubber-lined roll and a drive member having an annular groove and installed by means of a sliding key on the shaft of the drive roll and biased by a spring against the driven member of the clutch, a fork lever kinematically couples to the control drum and having rollers received in the annular groove of the drive member of the clutch, and an arm coupled by means of a cam to spring-biased brake shoes embracing the driven member of the clutch.

This arrangement of the stop motion of the mechanism for positive feed of warp threads ensures, in combination with the additional rest, the feed of a necessary number of warp threads of one system to the stitch forming zone in knitting the welt of a stocking, and, in combination with the main rest, it ensures the overturning of the welt owing to the provision of locking of the mechanism for positive feeding of warp threads by its stop motion.

The device controlling the change in the rate of feed of warp threads in accordance with a given program preferably comprises a cam which is loosely mounted on the control drum shaft and has a pin at the end face thereof engaging an arm secured to the control drum shaft, a ratchet-and-pawl mechanism having a ratchet wheel which is rigidly connected to the cam, a spring-biased control lever having a rod which has a roller engaging the cam, and a flexible link coupling it to the spring-biased slider of the device for steplessly controlling the rate of feed of warp threads, a double-arm lever having one arm linked by an intermediate member to the control drum, the other arm having a plate locking a pawl of the ratcher-and-pawl mechanism, and an arm supported by the spring-biased control lever and engaging the control drum.

This arrangement of the device controlling the change in the rate of feed of thread ensures the formation of the shape of a stocking by changing the length of loops in accordance with a given program. The device simultaneously controls the change in the force urging the rolls against one another and the force of the draw-off mechanism.

The invention is also characterized in that the device for spacing apart the rolls of the draw-off mechanism and for steplessly controlling their urging force comprises a rotatable frame which is coupled to the control drum by means of intermediate links supports the drive roll of the draw-off mechanism and is coupled to two arms secured to a rotatable shaft which is coupled by means of an arm and a system of levers to the control lever of the device controlling the rate of feed of warp threads in accordance with a pre-set program.

This arrangement ensures a change in the draw-off force applied to the hose to change the length of loops upon changes in the rate of feed of warp threads, since changing the rate of feed of the threads only is inefficient, and spacing the rolls apart enables the overturning of the welt so that the method of welt knitting under the action of the draw-off force may be carried out, and good extensibility of the welt may be ensured.

The invention is further characterized in that the stop motion of the main shaft comprises a sleeve which is loosely mounted on the main shaft and has a pulley of the machine drive, and a double-action cam clutch having a drive member fixed to the sleeve, a brake member secured to the machine frame of the coaxially with the main shaft, and a drive member mounted by means of a sliding key on the main shaft for moving therealong for alternately engaging the drive member and the braking member, the sleeve having gears transmitting the motion to the draw-off mechanism and to the control device of the machine, and the driven clutch member is coupled to the control drum of the control device of the machine by means of a fork with a roller, an intermediate shaft and a system of spring-linked levers. This arrangement enables an instant disengagement and locking in a given position of the racking and rocking mechanisms of the guide needles, mechanisms for moving the knitting needles and sinkers, and mechanisms for positive feed of warp threads during the knitting of the welt of a stocking, while leaving engaged the device controlling the mechanisms of the machine and transmitting the rotary motion to the draw-off rolls.

The preferred embodiment of the method and circular warp knitting machine for knitting stockings according to the invention will now be described with reference to accompanying drawings, in which:

FIG. 1 is a partial view showing the relative arrangement of stitch forming members of a circular warp knitting machine according to the invention;

FIG. 2 schematically shows a continuous hose consisting of serially arranged stockings;

Figure 1:
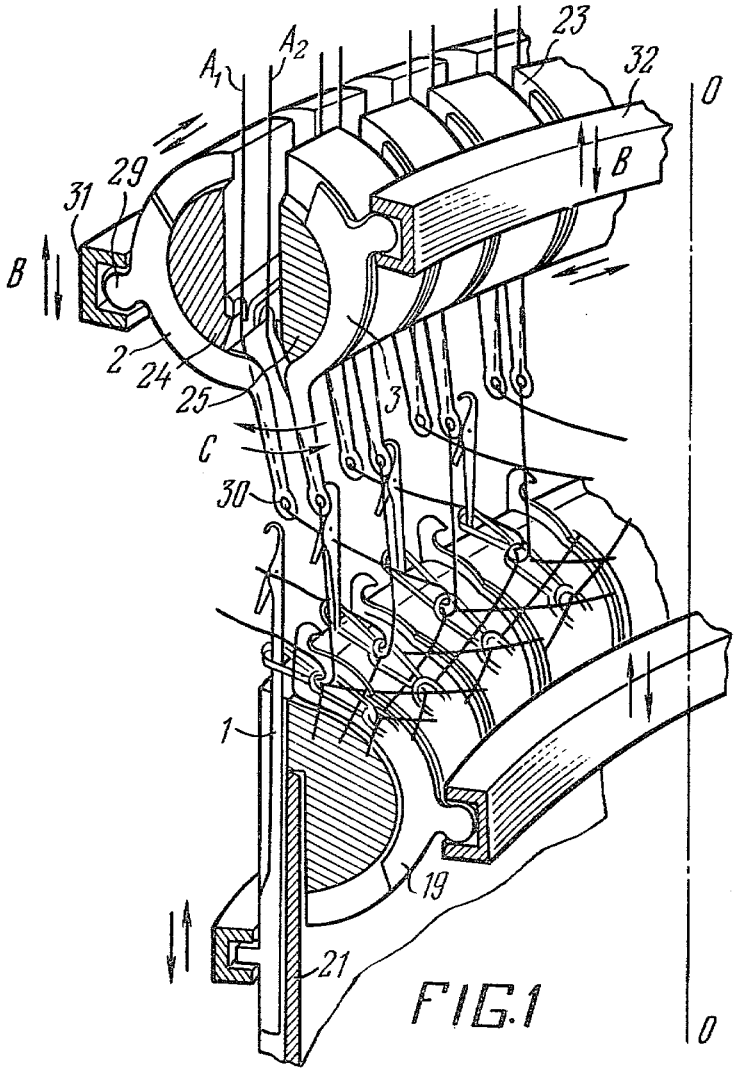

The method for knitting stockings on a circular warp knitting machine is carried out in the following manner.

Two systems of warp threads $A_1$ and $A_2$ are laid on knitting needles 1 (FIG. 1) by means of two sets of guide needles 2 and 3 which are caused to move along the front of and between the knitting needles 1, and a continuous hose 4 (FIG. 2) consisting of a plurality of serially arranged stocking 4*a* of a given length is knit from these threads under the action of a general draw-off force. Each stocking 4*a* comprises a garterband portion 5; an overturned welt 6 (FIG. 3); a leg 7 (FIG. 2) including a top cylindrical portion 8, a tapered portion 9 and an instep 10; a heel portion 11; a sole 12 with a tubular toe; pull courses 13; a boundary portion 14 between the tubular toe and the pull courses 13; a boundary portion 15 between the pull courses 13 and the garterband portion 5 of the next stocking.

In each stocking 4*a* the overturned welt 6 and the boundary portions 14 and 15 are knit in a known per se manner with one-bar tricot stitch from one system of warp threads, and all remaining portions 5,7,11,12 and 13 are knit with two-bar tricot stitch from two systems of warp threads. After the pull courses 13 of a stocking are knit, four-six courses of the garterband portion 5 are knit with the loop length which is at least equal to the loop length of the cylindrical portion 8 of the leg 7 thus ensuring the extensibility of the garterband portion 5 which is identical with the extensibility of the cylindrical portion 8 of the leg 7.

Figures 2, 3, 4:
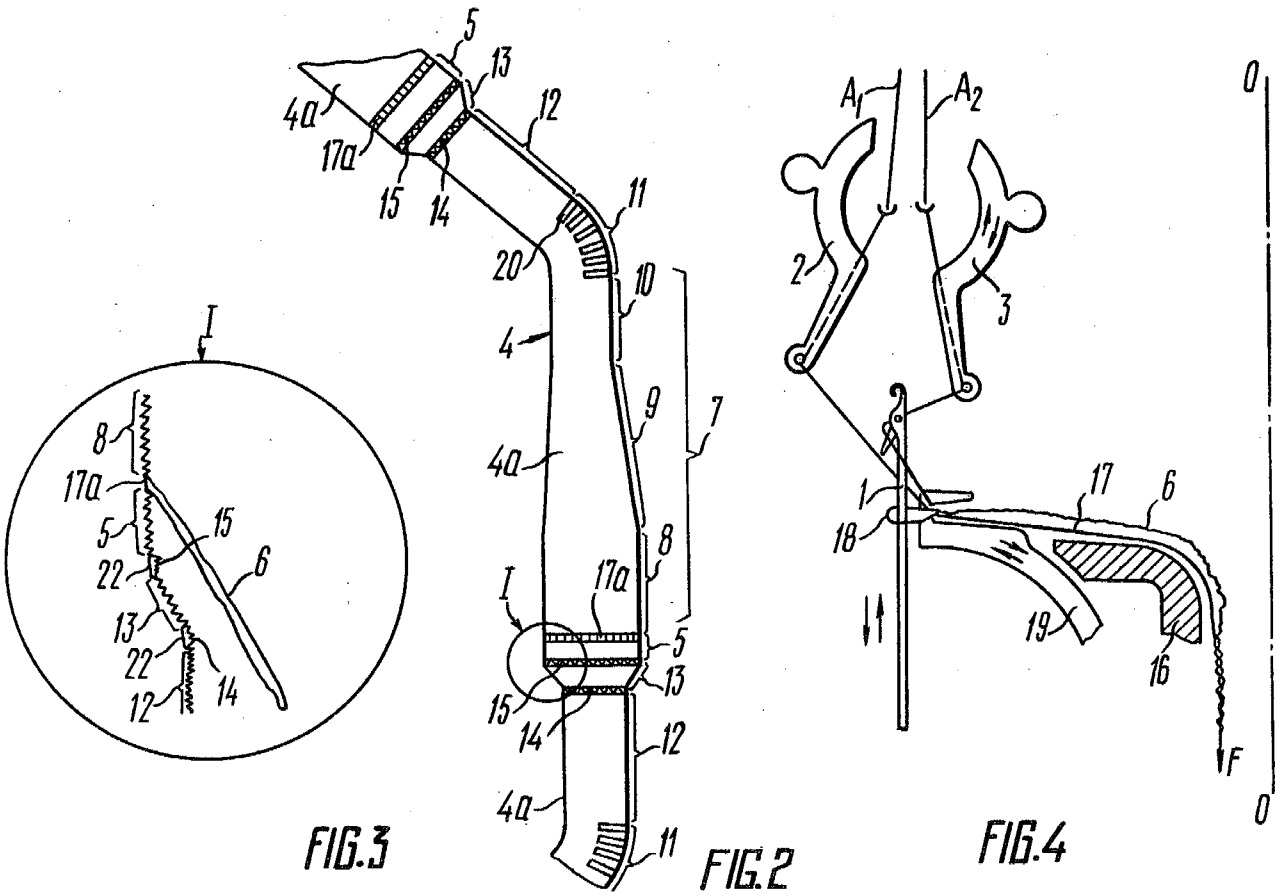
FIG. 3 is an enlarged sectional view of detail I in FIG. 1.
FIG. 4 shows the position of stitch forming members in knitting the welt.
Figure 5:
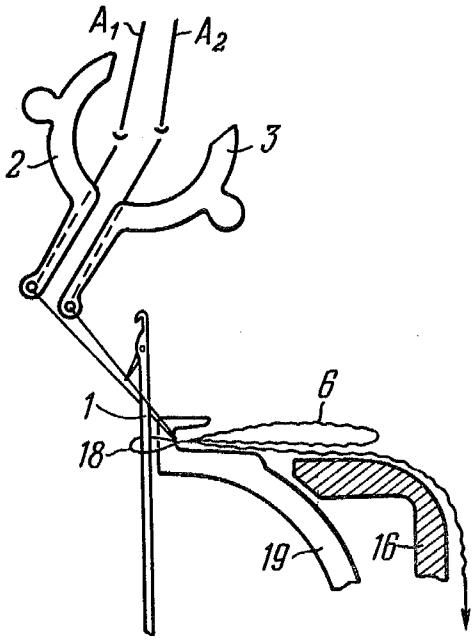
FIG. 5 shows the same as FIG. 4, at the end of overturning of the welt.

After the ultimate course of the garterband portion 5 with two-bar tricot stitch is knit one, e.g. outer set of guide needles 2 (FIG. 4) is disengaged, and the tension of the warp threads $A_1$ passing through this set of guide needles 2 is reduced to the minimum, whereby the welt 6 is knit with one-bar tricot stitch from the warp threads $A_2$ passing through the inner set of guide needles 3 which are caused to move between and along the front of the knitting needles 1, the courses of the welt 6 being formed under the action of the general draw-off force F which draw-off and diverges the knit welt into the interior of a funnel 16 of the needle cylinder. The warp threads $A_2$ of the outer set of guide needles 2 are also drawn-off together with the welt 6, and the rate of feed of these threads $A_1$ is set to be equal to the rate of knitting of the welt 6. As a result, the warp threads $A_1$ extend in the form of straight portions 17 under the knit welt portion 6. Subsequently, after the welt 6 is knit to a given length, the draw-off force F is removed, the warp threads $A_1$ are drawn-off in the direction opposite to their feed, whereby the first course of the welt 6 (FIG. 5) is brought to the ultimate course thereof which represents loops 18 on the knitting needles 1, thereby overturning the welt 6 as shown in FIG. 5.

The straight portions 17 of the threads $A_1$ (FIG. 4) are shortened to a maximum extent during the overturning of the welt 6 (FIG. 5), and define interconnecting threads 17*a* (FIG. 3) in the finished stocking to hold the welt 6 overturned.

After overturning the welt 6, the general draw-off force F is again applied to the stocking, the outer set of guide needles 2 is re-engaged, and the welt is sewed by laying together the warp threads $A_1$ and $A_2$ of both systems on the knitting needles 1, to form the first course of the leg 7. During overturning of the welt 6 (FIG. 5) all stitch forming members (needles 1, sinkers 19, guide needles 2 and 3) are disengaged and locked, both sets of guide needles 2 and 3 being locked in the position most distant from the center (that is from the axis 0—0 of the machine) as shown in FIGS. 5, the needles 1 in the top position, and the sinkers 19 in the position closest to the center.

Upon knitting the cylindrical portion 8 of the leg 7 (FIG. 7) the tapering portion 9, the instep 10, the heel portion 11, and the sole 12 with tubular toe are knit, the tapering portion being knit by gradually reducing the loop length in a known manner, and the heel portion 11 being unit in a known manner by inserting additional shorter courses (e.g. pairs of courses) between main parallel courses as schematically shown by rectangles 20, stitched on a portion of the knitting needles arranged on one side of the needle cylinder 21 (FIG. 1). As a result, there are twice as many courses on the side of the heel 11 (FIG. 2) as on the instep side.

After knitting the sole and tubular toe portion 12 the boundary portion 14 is knit. For that purpose, the outer set of guide needles 2 is disengaged and, for instance, two courses are made with one-bar tricot stitch from the warp threads $A_2$ of the inner set of guide needles 3. In knitting the boundary portion 14, the action of the general draw-off force is maintained, and the warp threads $A_1$ passing through the disengaged guide needles 2 continue to be fed to the stitch forming zone, these threads extending in the form of straight portions 22 (FIG. 3) along stitch wales. Owing to the maintenance of the general draw-off force applied to the loops of the boundary portion 14 being knit and the feed of the warp threads $A_1$ to the stitch forming zone, no overturning of one-bar tricot stitch courses occurs.

After knitting the boundary portion 14, four-six pull courses 13 are knit by re-engaging the outer set of guide needles 2. As a result the pull courses 13 are knit with two-bar tricot stitching. When the knitting of the pull courses 13 begins, the machine is switched over for the density of the garterband portion 5 with the loop length substantially greater than the loop length of the sole portion 12, the switching being made by increasing the rate of feed of the warp threads $A_1$ and $A_2$ of both systems. The loop length on the pull courses portion 13 is not changed instantaneously, but rather gradually owing to the inertia of the process of variation of loop length on a circular warp knitting machine. By the end of knitting of the pull courses 13 the process is stabilized, and the courses are knit with the loop length equal to the loop length of the garterband portion 5 (FIG. 2) so that the diameter of the pull courses 13 increases during knitting thereof.

After knitting the pull courses 13, the boundary portion 15 is knit before knitting the garterband portion 5, the boundary portion 15 being knit in the same manner as the boundary portion 14. Subsequently the garterband portion 5 is knit for the next stocking, wherein all other portions are knit as described above.

The welt 6 and the boundary portions 14 and 15 may be knit with one-bar tricot stitch also from the warp threads $A_1$ of the outer set of guide needles 2 with the inner set of guide needles 3 disengaged.

The resultant hose 4 is cut into individual stockings by cutting across the course of the garterband portion 5 immediately following the boundary portion 15. The boundary portions 14 and 15 are easily discernible in a stocking so that the detection of the point of separation of one stocking from another presents no problem and does not require any auxiliary devices for determining the length of a stocking.

The toe of each stocking is sewed-up by any known method using as a mark the boundary portion 14, and the portions 14, 13 and 15 are cut away concurrently with the sewing-up of the toe. Several courses of the garterband portion 5 knit with two-bar tricot stitch remaining in the stocking protect the welt against unraving.

The method for knitting a stocking according to the invention is carried out on a circular warp knitting machine which is not shown completely in FIG. 1 so as not to overcrowd the drawing, the machine comprising: a needle cylinder 21 having knitting needles 1 which are caused to reciprocate vertically by means of known per-se devices, and sinkers 19 which are also caused to move radially by known per se devices; two sets of outer 2 and inner 3 guide needles which are caused to move between the knitting needles 1 and received in grooves 23 of two concentrically arranged annular guide bars 24 and 25, respectively, which are caused to move along the front of the knitting needles; two systems of the warp threads $A_1$ and $A_2$; mechanisms 26 (FIG. 6) for positive feed of warp threads of each system; a draw-off mechanism 27 (FIG. 7) and any known per se control device of the machine comprising a control drum 28 having cam surfaces and members engaging the drum and kinematically coupled to respective mechanisms for controlling their operation, that is engagement and disengagement.

Figure 8:
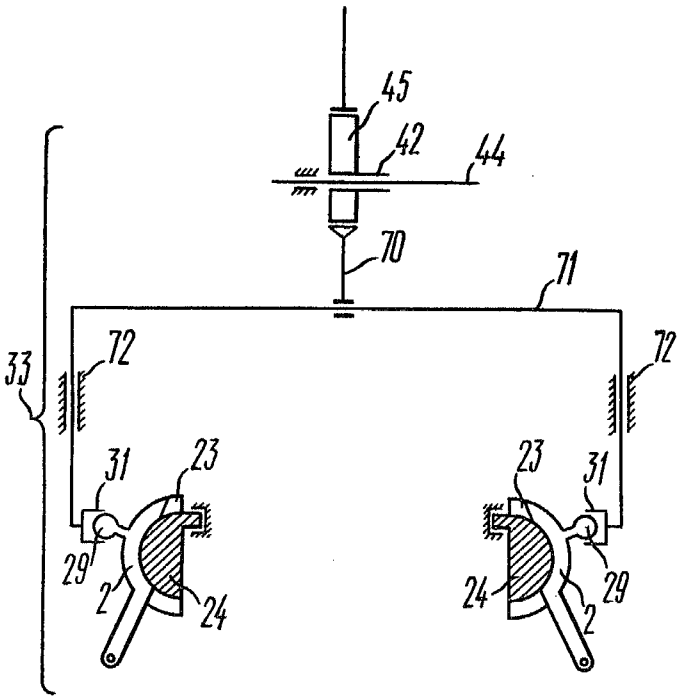
FIG. 8 shows a kinematic chain diagram of the rocking mechanism, e.g. for the outer set of guide needles.

The guide needles 2 and 3 (FIG. 1) comprise crescentshape plates each having a round butt 29 and an elongated portion having an eyelet 30 for the passage of the warp threads $A_1$ and $A_2$, respectively. The butts 29 of the guide needles 2 and 3 are received in annular cams 31 and 32, respectively, which are caused to reciprocate in the direction shown by arrows B by any known per se rocking mechanism 33 which is diagrammatically shown in FIG. 8. As a result, the guide needles 2 and 3 (FIG. 1) are caused to perform a rocking motion in the direction shown by arrows C and pass between the knitting needles 1.

Figure 9:
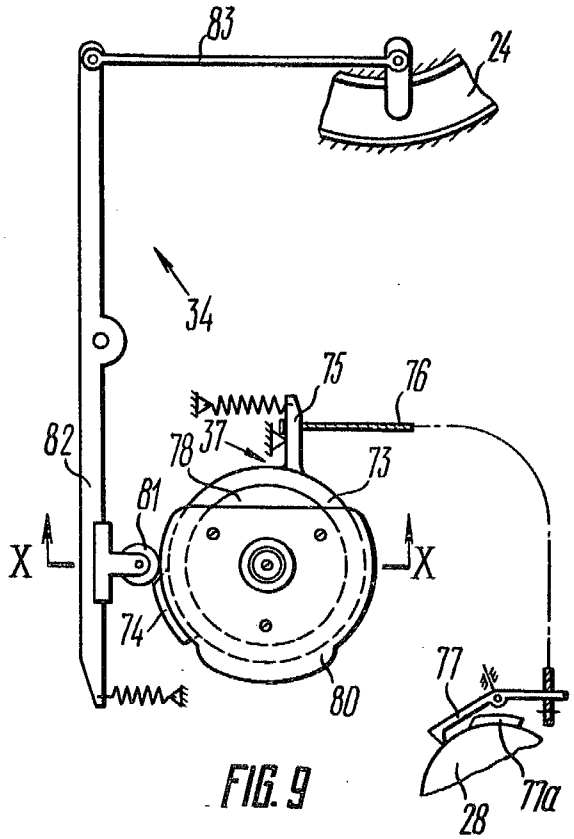
FIG. 9 shows a kinematic chain diagram of the mechanism for moving, e.g. the outer annular guide bar along the front of the knitting needles.
Figure 10:
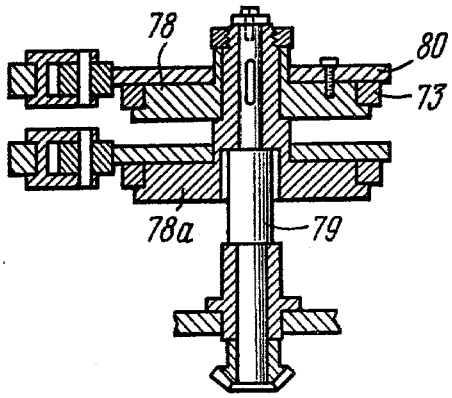
FIG. 10 is a sectional view taken along the line X—X in FIG. 9.

The annular guide bars 24 and 25 are caused to move along the front of the knitting needles by a known per se racking mechanism 34 (FIGS. 9, 10), the racking mechanisms 34 and the rocking mechanisms 33 for the guide needles 2 are similar to respective mechanisms for the guide needles 3 so that their structural embodiment is shown for the outer set of guide needles 2 only.

The racking mechanism 34 used for the outer guide bar 24 is adapted to disengage its guide bar 24 so that various portions of a stocking may be knit with one-bar tricot stitch from the warp threads passing through the other, engaged set of guide needles 3.

Figure 11:
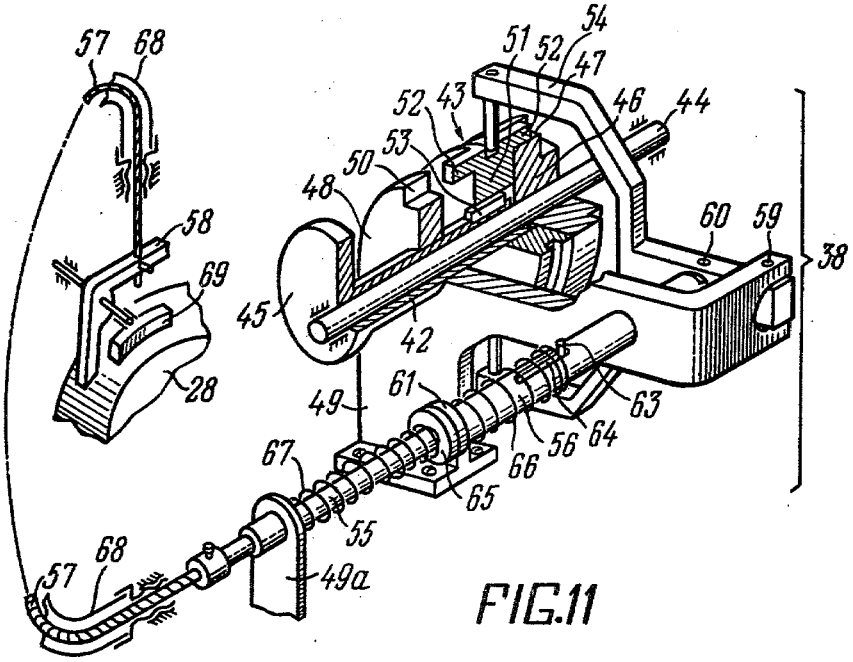
FIG. 11 is a perspective view of a stop motion of the guide needle rocking mechanism.
Figure 12:
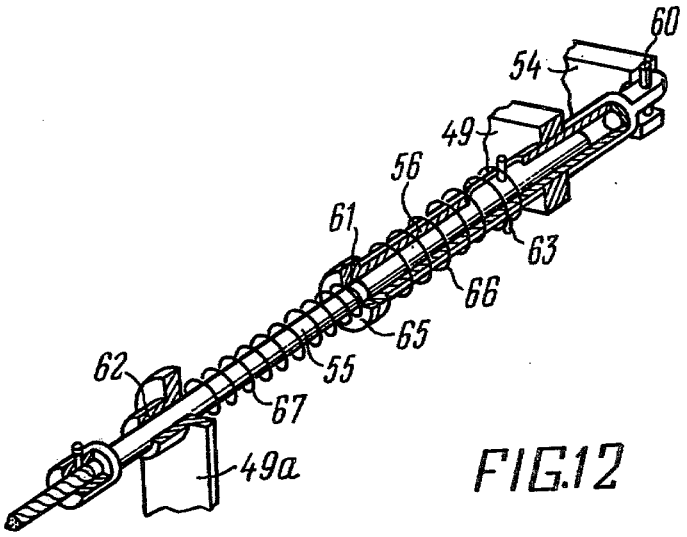
FIG. 12 shows the relative arrangement of the telescoping rods of the stop motion of FIG. 11.
Figure 13:
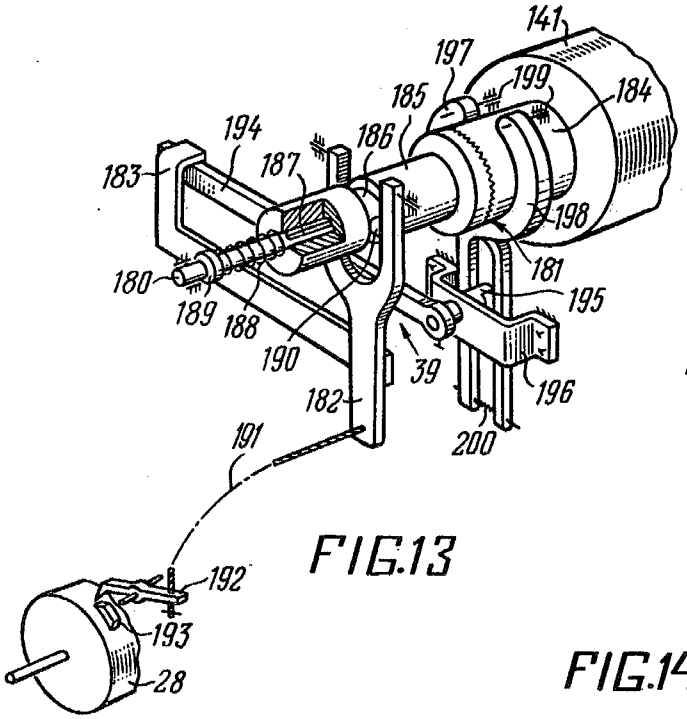
FIG. 13 is a perspective view of the stop motion of the mechanism for positive feed of warp threads.

According to the invention, the circular warp knitting machine for carrying out the method of the invention is provided with: a stop motion 35 (FIG. 7) of a main shaft which controls the motion of stitch forming members (knitting needles 1, sinkers 19, racking mechanism 34, rocking mechanism 33 of both sets of guide needles 2 and 3, and mechanisms 26 for positive feed of warp threads of both systems); individual stop motions 37 (FIG. 9) and 38 (FIGS. 11, 12) of the racking mechanism 34 and rocking mechanism 33, respectively, of the set of guide needles, which is disengaged, e.g. the outer set of guide needles 2; a stop motion 39 (FIG. 13) of the mechanism 26 for positive feed of warp threads passing through the disengaged set of guide needles; a device 40 (FIG. 14) for spacing apart the rolls of the draw-off mechanism, 27 and for steplessly controlling the force of their urging. Furthermore, each mechanism for positive feed of warp threads in the machine is provided with a device 41 (FIG. 15) for steplessly controlling the rate of feed of warp threads.

All above-mentioned stop motions 35,37,38,39, as well as the device 41 for steplessly controlling the rate of feed of warp threads and the device 40 for spacing apart the rolls of the draw-off mechanism 27 and for steplessly controlling their urging force are kinematically coupled to the control drum 28 of the control device of the machine, the control drum being provided with additional cam surfaces for controlling the stop motions, which comprise straps engaged by intermediate members of the kinematic chain of stop motions.

The stop motion 38 (FIG. 11) of the rocking mechanism 33 of the outer set of guide needles 2 comprises a sleeve 42 and a cam clutch 43.

The sleeve 42 is loosely mounted on a drive shaft 44 of the machine. A member 45 imparting motion to the rocking mechanism 33 (FIG. 8), such as an eccentric is secured to the sleeve 42.

The cam clutch 43 (FIG. 11) comprises: a drive member 46 secured to the drive shaft 44 of the machine and having a groove 47; a braking member 48 secured to machine frame 49 coaxially with the drive shaft 44 and having a groove 50; a double-action driven member 51 having cams on both sides to be received in the grooves 47 and 50, respectively. The driven member 51 is mounted on the sleeve 42 by means of a sliding key 53 so that it can move along the sleeve 42 for alternately engaging the drive member 46 or the braking member 48 of the clutch.

The stop motion 38 of the rocking mechanism 33 is kinematically coupled to the control drum 28 by means of a fork lever 54, two telescoping rods 55 and 56 (received in one another) and intermediate links 57 and 58, such as a cable and a double-arm lever, respectively.

The fork lever 54 embraces the driven clutch member 51 and is secured to the frame 49 of the machine by means of a pivot 59. The rod 56 comprises a sleeve (FIG. 12) extending through the bore of the frame 49 and having one end which is locked by a pin 60 in the hole of the fork lever 54, the other end having a flange 61. One end of the rod 55 is freely received in a guide bore 62 of the frame 49*a*, and the other end thereof is received in the rod 56. A pin 63 is secured to the rod 55 and extends through longitudinal guide slots 64 (FIG. 11) of the rod 56, and the rod 55 has a flange 65 in the middle part thereof.

A compression spring 66 is installed on the rod 56 between the flange 61 and the pin 63. A compression spring 67 is installed on the rod 55 between the frame 49*a* and the flange 65.

An end of the cable 57 extending inside a stationary casing 68 is secured to the free end of the rod 55. The other end of the cable 57 is secured to the lever 58 having one end thereof permanently engaging the surface of the control drum 28, and a strap 69 is provided on the control drum 28 to control operation of the stop motion 38.

In the rocking mechanism 33 (FIG. 8) of the guide needles 2, the eccentric 45 is linked by means of a connecting rod 70 to a fork 71 which extends through guides 72 and has an annular cam 31 embracing the butts 29 of the guide needles 2. The rocking mechanism 33 of the guide needles 3 is of a similar structure and not shown in FIG. 8.

The stop motion 37 (FIG. 9) of the racking mechanism 34 comprises a spring-biased ring 73 having a boss 74 on the outer periphery thereof and an arm 75, the ring being kinematically coupled to the control drum 28, e.g. by means of a cable 76 and a double-arm lever 77.

The ring 73 is rotatably mounted on a rotary plate 78 of a drive shaft 79 (FIG. 10) of the racking mechanism 34. The racking mechanism 34 (FIG. 9) has a profiled cam 80 secured to the plate 78 and a roller 81 urged thereagainst by a spring and secured to a double-arm lever 82. The double-arm lever 82 is linked by means of a draw-bar 83 to the outer guide bar 24.

The radius of the outer surface of the boss 74 is equal to maximum radius of the profiled cam 80, and upon rotation of the ring 73, the boss 74 is brought beneath the roller 81 to keep the roller 81 retracted from the profiled cam 80.

The shaft 79 has a plate 78*a* (FIG. 10) arranged beneath the plate 78 and similar thereto, for imparting motion to the racking mechanism 34 of the inner guide bar 25.

The stop motion 35 of the main shaft 36 (FIG. 7) comprises a sleeve 84 which is loosely mounted on the main shaft 36 and a double-action cam clutch 85.

Rigidly fixed to the sleeve 84 are a gear 86 of the control device of the machine, a gear 87 for transmitting motion to the draw-off mechanism 27, and a pulley 88 of the machine drive.

The cam clutch 85 comprises a drive member 89 rigidly connected to the sleeve 84, a braking member 90, secured to the frame 49 of the machine coaxially with the main shaft 36, and a driven member 91 with cams 92 on either side which is mounted by means of a sliding key 93 on the main shaft 36 of the machine for moving along the shaft 36 and for alternately engaging the drive member 89 and the braking member 90 of the clutch.

Figure 16:
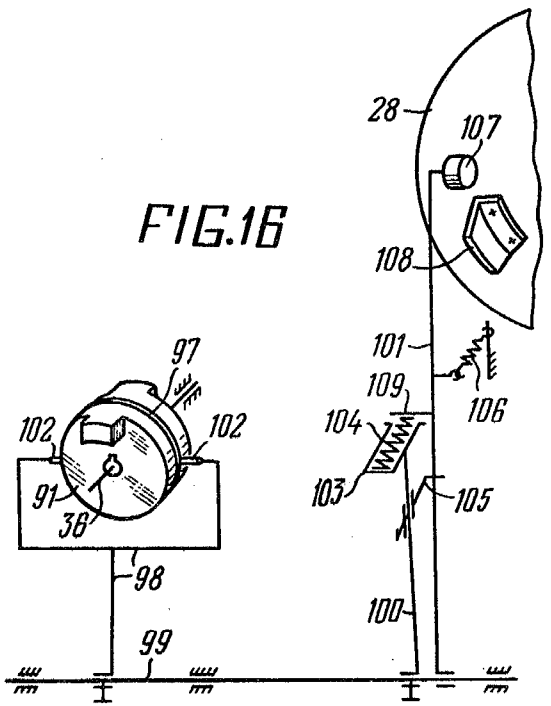
FIG. 16 is a kinematic chain diagram of stop motion of the main shaft of the machine.

Motion imparting members 94,95,96, such as cams, eccentrics, gears which impart movement to stitch forming members, namely knitting needles 1, sinkers 19, mechanisms 26 for positive feed of warp threads and drive shafts of the racking mechanism 34 and rocking mechanism 33, are secured to the main shaft 36. The driven member 91 has an annular groove 97 and is connected to the control drum 28 of the control device of the machine by means of a fork lever 98 (FIG. 16), an intermediate shaft 99 and a system of levers 100 and 101 interconnected by springs. The fork lever 98 has rollers 102 and embraces the driven member 91 so that the rollers of the fork lever 98 are received in the annular groove 97 of the driven member. The fork lever is rigidly fixed to the intermediate shaft 99 which is journalled in bearings and has a lever 100. The lever 100 has a case 103 with a compression spring 104 and a stop 105. The lever 101 is mounted in the intermediate shaft 99 for rotation, is connected by means of an expansion spring 106 to the machine frame and has at the end a roller 107 engaging an auxiliary cam surface of the control drum 28 which is formed by the end face of the drum 28 and a strap 108. A stop 109 for the spring 104 is mounted on the lever 101.

Figure 7:
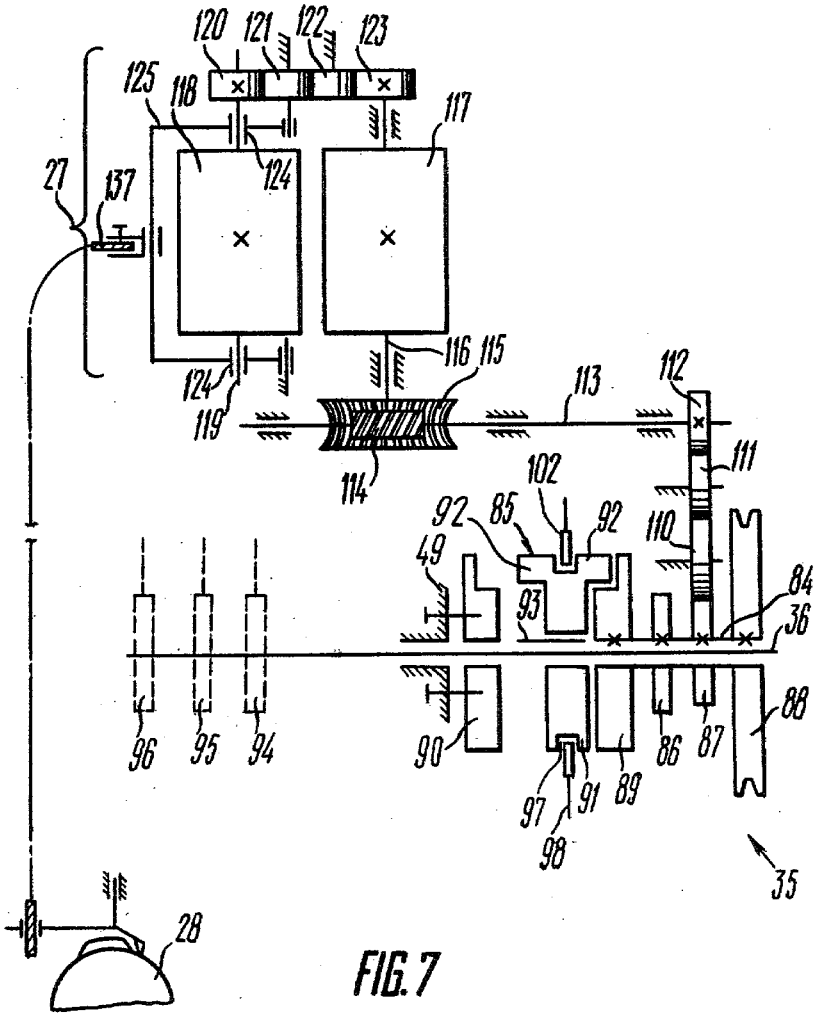
FIG. 7 shows a kinematic chain of the machine drive and draw-off mechanism.

Idle gears 110 and 111 and a driven gear 112 which is secured to an intermediate shaft 113 transmitting motion to the draw-off mechanism 27 mesh with the gear 87 (FIG. 7). The intermediate shaft 113 is connected by means of a worm gear with a drive shaft 116 of the draw-off mechanism 27. The draw-off mechanism 27 has two fluted rolls 117 and 118; the roll 117 is a drive roll secured on the drive shaft 116, and the driven roll 118 is secured to a shaft 119. The shaft 119 is connected to the drive shaft 116 by means of gears 120, 121, 122 and 123. The shaft 119 is journalled in bearings 124 mounted on a rotatable frame 125 (FIG. 14) of the device 40 for spacing apart the rolls 117 and 118 of the draw-off mechanism and for steplessly controlling their urging force.

The device 40 for spacing apart the rolls 177 and 118 comprises the rotatable frame 125 and two arms 126. Uprights **125*a* of the frame 125 are rotatably mounted on an axle 127 of the gear 121 and are connected by springs 128 to the arms 126. The arms 126 are rigidly fixed to the rotatable shaft 129 which is coupled, by means of an arm 130, a system of pivotally interconnected levers 131,132,133 and a cable 134, to, a control lever 135 (FIG. 17) of a device 136** for controlling the change in the rate of feed of warp threads in accordance with a given program.

The rotatable frame 125 (FIG. 14) is connected to the control drum 28 having a strap 139 for controlling the rotation of the frame 125, by means of a kinematic chain which may include a cable 137 and a double-arm lever 138.

Figure 6:
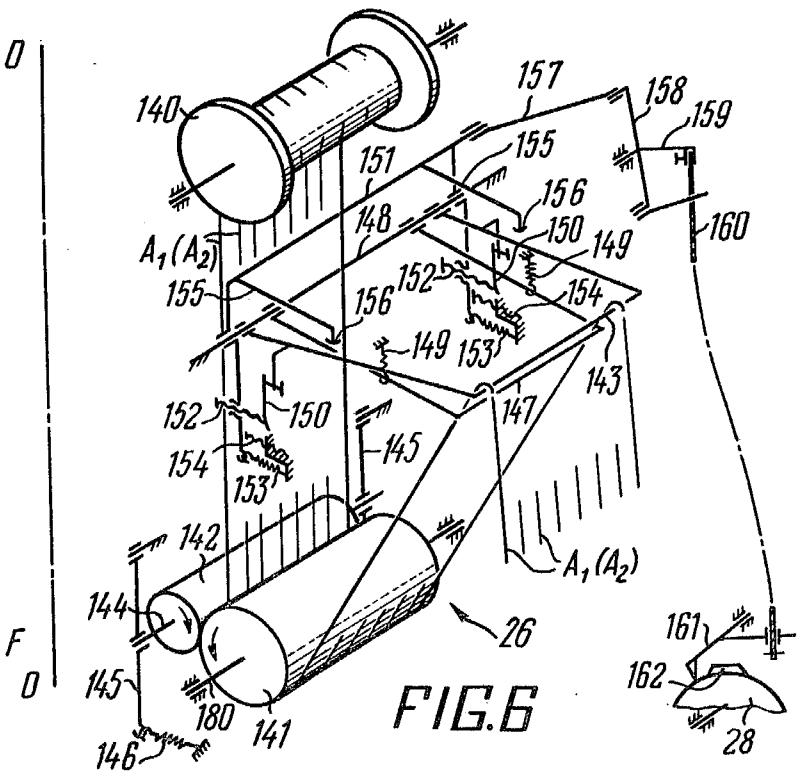
FIG. 6 shows a kinematic chain diagram of the mechanism for positive feed of warp threads.

Two identical mechanisms 26 (FIG. 6) for positive feed of warp thread for each set of guide needles 2 and 3 are installed over the guide bars in mirror-like opposition to one another, FIG. 6 showing only one mechanism.

Each mechanism 26 for positive feed of warp threads comprises a spool 140 with the warp threads $A_1(A_2)$, a drive rubber-lined roll 141 having a rubber-lined pressure roll 142 and a main spring-biased rest 143.

Axle 144 of the rubber-lined roll 142 is journalled in bearings mounted on two arms 145 urging the roll 142 against the roll 141 under the action of springs 146. Apart from the main spring-biased rest 143, each mechanism 26 for positive feed of warp threads comprises an additional spring-biased rest 147 around which the warp threads $A_1(A_2)$ extend as shown in FIG. 6.

The additional rest 147 is installed immediately adjacent to the main rest 143 on the same axle 148 therewith and is urged by springs 149 secured to the machine frame.

The main spring-biased rest 143 is retractile from the zone of engagement of the warp threads $A_1(A_2)$, and for that purpose, the rest 143 is coupled with leaf springs 150 thereof to a spring-biased rotatable frame 151 having its bearings on the axle 148. The leaf springs 150 are supported by adjustment screws 152 mounted on the lower ends of the frame 151, the lower ends of the frame 151 being connected by means of expansion springs 153 to the machine frame having adjustment stop screws 154 for acting on the ends of the frame 151.

Secured to the frame 151 are arms 155 with stops 156 acting on the main rest 143 upon rotation of the frame 151. The rotatable frame 151 is connected to the control drum 28 having a astrap 162 by means of a system of levers 157,158,159, a flexible link (cable 160) and a double-arm lever 161, the double-arm lever 161 engaging the strap 162 for controlling rotation of the main spring-biased rest 143.

The device 41 (FIG. 15) for steplessly controlling the change in the rate of feed of each mechanism 26 for positive feed of warp threads comprises an eccentric 163 mounted on a drive shaft 164, a spring-biased slider 165 and two overrunning clutches 166 and 167 mounted on an intermediate shaft 168 and angularly displaced relative to one another.

The eccentric 163 is linked by means of a connecting rod 169 to a lever 170 extending through a sliding block 171 pivoted in machine frame and secured by a screw 172 to the lever 170 so that the lever 170 and the slider 165 perform a rocking motion.

The slider 165 is mounted on the lever 170 by means of a sliding key 173 and is biased by expansion springs 174, the springs 174 being adjustable on the lever 170 by means of a sliding block 175 and a screw 176. The slider 165 is also connected by means of the cable 134 to the device 136 (FIG. 17) for controlling the change in the rate of feed of warp threads in accordance with a given program.

Each of the overriding clutches 166 and 167 (FIG. 15) is linked by means of drawbacks 177 to the slider 165 so as to transform the rocking motion of the slider 165 into rotary motion of the intermediate shaft 168.

The intermediate shaft 168 is kinematically coupled by means of gears 178 and 179 to shafts 180 of the drive rubber-lined rolls 141 of the mechanisms 26 for positive feed of warp threads, the shaft 180 being connected to the drive roll by means of a stop motion 39 of the mechanism 26.

The stop motion 39 (FIG. 13) of the mechanism 26 for positive feed of warp threads comprises, for each drive rubber-lined roll 141, a fine-tooth clutch 181, e.g. with a triangular tooth profile, a fork lever 182 and an arm 183.

A driven member 184 of the clutch 181 is secured to the end face of the drive rubber-lined roll 141, and the drive member 185 has an annular groove 186 and is mounted by means of a sliding key 187 on the shaft 180 of the drive rubber-lined roll 141. The drive member 185 is elastically urged against the driven member 184 of the clutch by a compression spring 188, one end of the spring 188 being fixed by a thrust washer 189 fixed to the shaft 180.

The drive member 185 of the clutch 181 is surrounded by the fork lever 182 having rollers 190 received in the annular groove 186. The free end of the fork lever 182 is kinematically coupled, e.g. by means of a cable 191 and a double-arm lever 192, to the control drum 28 having a strap 193 to control the stop motion 39.

The fork lever 182 has the arm 183 engaging a lever 194 provided with a cam 195 with an axle in a support 196 secured to the machine frame. The cam 195 is arranged between elongated ends of braking shoes 197 and 198 enbracing the driven member 184 of the clutch 181. The ends of the brake shoes 197 and 198 are rotatably mounted on axles 199 in the frame and tied up by a spring 200.

The device 136 controlling change in the rate of feed of warp threads in accordance with a given program (FIG. 17) comprises a cam 201, a ratchet-and-pawl mechanism, a spring-biased control lever 135, a double-arm lever 202 and an arm 203.

The cam 201 is made with an Archimedian spiral profile, freely mounted on a shaft 204 of the control drum 28 and has a pin 205 at the end face thereof. An arm 206 is rigidly fixed to the shaft 204 of the control drum 28 to cooperate with the pin 205 of the cam 201.

A ratchet wheel 207 of the ratchet-and-pawl mechanism is rigidly connected to the cam 201, and the pawl 208 is connected by means of a double-arm lever 209 to a connecting rod 210 having a collet embracing an eccentric 211 rigidly secured to a drive shaft 212.

The double-arm lever 202 is rotatably mounted on the shaft 204 and has at one arm thereof a plate 213 which locks the pawl 208 of the ratchet-and-pawl mechanism, and the other arm of the lever is coupled, via intermediate members—cable 214 and an double-arm lever 215 to the control drum 28 of the machine control device, having a strap 216 for cooperation with the double-arm lever 215 and for controlling operation of the device 136.

The double-arm lever 202 is biased by a compression spring 217 secured to the machine frame.

A roller 218 rolling over the cam 201 is mounted on a rod 219 which is secured by means of a stop screw 220 to a sliding sleeve 221. The sliding sleeve 221 is fixed by a screw 222 to the control lever 135.

The control lever 135 is linked with one end thereof, via a slider 223, to an arm 224, the slider 223 being fixed by a screw 225 to the control lever 135, and the arm 224 is secured by a screw 226 in an elongated hole to the machine frame. The other end of the control lever 135 is biased by an expansion spring 227 and is coupled, e.g. by means of the cable 134 to the spring-biased slider 165 (FIG. 15) of the device 41 for steplessly controlling the rate of feed of warp threads and device 40 (FIG. 14) for spacing apart the rolls of the draw-off mechanism 27 and for steplessly controlling their urging force.

The arm 203 (FIG. 17) is linked with one end thereof to the machine frame and has an adjustment screw 228 at the other end which abuts freely against the control lever 135, and an arm 229. The arm 203 has two adjustment screws 230 and 231 located opposite to corresponding cam surfaces of the control drum 28 made in the form of straps 232 and 233, respectively.

Figure 18:
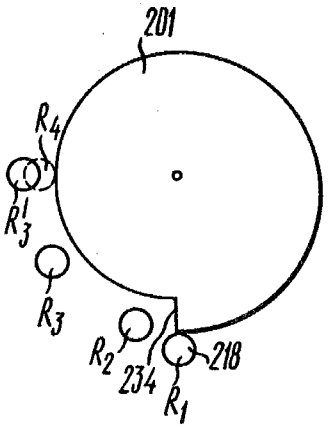
FIG. 18 shows various positions of the roller with respect to a cam in the device shown in FIG. 17.

FIG. 18 shows various positions of the roller 218 with respect to the cam 201 in knitting various portions of a stocking.

The circular warp knitting machine according to the invention functions in the following manner.

Since the circular wrap knitting machine units the continuous hose 4 (FIG. 2) consisting of serially arranged stockings, the operation of the machine will be described as applied to the knitting of one stocking 4*a*, including the garterband portion 5, the overturned welt 6, the leg 7 (including the top cylindrical portion 9, the tapering portion 9 and the instep 10), the heel portion 11; the sole 12 with tubular toe. The pull courses 13, the boundary portion 14 between the toe and the pull courses, and the boundary portion 15 between the pull courses and the garterband portion 5 are knit between the adjacent stockings 4*a*. Therefore, the knitting of each stocking in the continuous hose begins with the garterband portion 5 which is knit with two-bar tricot stitch. At this time all stitch forming members of the machine are engaged.

In knitting all portions of a stocking, except for the welt 6 and the boundary portions 14 and 15, the racking mechanisms 34 of both sets of guide needles 2 and 3 function in the following manner, the operation of the mechanisms being described for the outer set of guide needles 2.

In laying the warp threads $A_1$ (FIG. 1) on the knitting needles 1 the guide needles 2 are caused, together with their guide bar 24, to perform racking motions along the front of the knitting needles 1.

The guide bar 24 (FIG. 9) is caused to perform this motion by the mechanism 34 by means of the drawbar 83 and the spring-biased double-arm lever 82 which cooperates, by means of the roller 81, with the profiled cam 80 or with the spring-biased ring 73. The cam 80 is rotated by the drive shaft 79 (FIG. 10) by means of the plate 78. At point where the radius of the profile of the cam 80 (FIG. 9) is smaller than the outer radius of the spring-biased ring 73, the roller 81 is supported by the ring 73 which complements the profiled cam 80. Under these conditions the lever 77 abuts against the surface of the control drum 28, the cable 76 is relaxed, the spring-biased ring 73 bears with the arm 75 against the machine frame, and the boss 74 is out of engagement with the roller 81.

When the mechanism 34 (FIG. 9) is stopped to eliminate the racking motion of the guide bar 24 so as to knit the boundary portions 14 and 15 (FIGS. 2 and 3) or the welt 6 of a stocking, the control drum 28 (FIG. 9) is rotated, and the strap 77*a* engages the double-arm lever 77. The occurs at the moment when the roller 81 engages the portion of the profile of the cam 80 having the largest radius. The double-arm lever 77 is pivoted to rotate, by means of the cable 76 and the arm 75, the ring 73 and to bring the boss 74 of the ring 73 beneath the roller 81. The boss 74 corresponds to the largest radius of the profiled cam 80 so that the boss, which remains beneath the roller 81, keeps the roller from engaging the rotary cam 80. As a result the roller 81, double-arm lever 82, drawbar 83 and guide bar 24 remain stationary, and the guide bars 2 (FIG. 1) are not caused to move along the front of the knitting needles 1.

To re-engage the guide bar 24 (FIG. 9) after the portions 14,15 and 6 are knit (FIGS. 2 and 3), the control drum 28 (FIG. 9), rotates, the strap 77*a* is disengaged from the double-arm lever 77, the cable 76 is relaxed, the spring-biased ring 73 returns back to the initial position, and the boss 74 is disengaged from the roller 81 which engages the portion of the cam profile 80 of the largest radius equal to the radius of the boss 74, which passes under the roller at that moment. The racking mechanism 34 is then re-engaged.

The stop motion 33 of the rocking mechanism 33 of the guide needles 2 functions in the following manner.

In knitting all portions of a stocking (FIGS. 2,3), except for the welt 6 and the boundary portions 14 and 15, the eccentric 45 (FIG. 8) is permanently caused to rotate and imparts reciprocations to the annular cam 31 by means of the connecting rod 70 and the sliding frame 71, the cam acting on the butts 29 of the guide needles 2 imparting thereto the rocking motion in the grooves 23 of the guide bar 24. In this mode of operation the eccentric 45 of the rocking mechanism 33 of the guide needles is caused to rotate by the drive shaft 44 (FIG. 11) via the drive clutch member 46, driven clutch member 46, driven clutch member 51, sliding key 53 and sleeve 42.

The drive member 51 is brought into engagement with the drive member 46 at this time by means of the fork lever 54 which urges the clutch member 51 against the clutch member 46 under the action of the spring 67 through the flanges 65 and 61, the rod 56 and the pin 60 acting directly on the fork lever 54, the end of the lever 58 being on the surface of the control drum 28 and the cable 57 being relaxed.

When the machine is switched over for knitting the portions 14, 15 and 6 (FIGS. 2 and 3), the control drum 28 (FIG. 11) rotates to disengage the rocking motion of the guide needles, and the strap 69 is engages the lever 58. When the lever 58 is pivoted by the strap 69, the cable 57 moved the rod 55 to compress the spring 67 by its flange 65, the action of the spring 67 on the rod 56 is removed, and the pin 63 of the rod 55 is caused to move in the elongated holes 64 of the rod 56 to compress the spring 66. The spring 66 acts on the flange 61 to turn, by means of the rod 56 and pin 60, the fork lever 54 which causes the displacement of the driven clutch member 51 until the cam 52 thereof engages the end face of the braking member 48. The driven clutch member 51 continues to rotate without coming out of engagement with the drive clutch member 46. When the cam 52 of the drive member approaches the groove 50 of the braking member 48, the spring 66, by means of the flange 61, rod 56, pin 60 and the fork lever 54 causes further displacement of the driven clutch member so that one cam 52 thereof enters the groove 50 of the braking member 48, and the other cam 52 thereof leaves the groove 47 of the drive member 46. The braking member 48, by means of the driven member 51, sliding key 53 and sleeve 42, stops and locks in the fixed position the eccentric 45 and further, via the kinematic chain of the mechanism 33 (FIG. 8), stops and locks the annular cam 31 and the guide needles 2 of the outer set.

When the machine is switched over again to impart rocking motion to the guide needles 2 (FIG. 8), the strap 69 (FIG. 11) is disengaged from the lever 58 upon rotation of the control drum 28, the cable 57 releases the rod 55 which, under the action of the spring 67 causes the driven member 51 of the clutch to move toward the drive member 46, by means the flanges 65 and 61, pin 60 and the fork lever 54, until the cam 52 of the driven clutch member 51 abuts against the end face of the drive member 46. The driven clutch member 51 is not yet disengaged from the braking member 48 and continues to lock the eccentric 45 and the entire mechanism 33 in the inoperative position. When the groove 47 (FIG. 11) of the drive member 46 approaches the cam 52 of the driven clutch member 51, the spring 67 causes the driven clutch member 51 to move further into engagement with the drive clutch member 46 and to disengage the clutch member 51 from the braking member 48. The eccentric 45 is caused to rotate and the mechanism 33 (FIG. 8) is caused to impact rocking motion to the guide needles 2 of the outer set.

The mechanism 27 (FIG. 6) for positive feed of warp threads of the machine functions in the following manner.

In the mode of stitch formation on the portions 5,6,7,11,12, 13,14 and 15 (FIGS, 2 and 3) of the stocking 4*a*, except for the formation of straight thread portions 17*a*, the warp threads $A_1(A_2)$ (FIG. 6) are taken-up from the spool 140 by the drive rubber-lined roll 141 and pass between this roll 141 and the rubber-lined roll 142 urged thereagainst. The urging is effected by the springs 146 acting on the arms 145 supporting the axle of the rubber-lined roll 142. The warp threads further extend around the main spring-biased rest 143 and the additional spring-biased rest 147 and are fed to the eyelets 30 (FIG. 1) of the guide needles 2 which lay the warp threads on the knitting needles 1 forming loops therefrom. In this operation mode the main rest 143 (FIG. 6) and the additional rest 147 function as shock absorbers for the threads to ensure normal stitch formation.

The drive rubber-lined roll 141 (FIG. 15) is caused to rotate by the eccentric 163 rotating with the drive shaft 164, via the connecting rod 169, lever 170, slider 165, drawbars 177, two overriding clutches 166 and 167, intermediate shaft 168, pair of gears 178 and 179, shaft 180 and stop motion 39. Oscillatory motion of the lever 170 and the slider 165 imparted by the eccentric 163 is transformed into rotary motion of the intermediate shaft 168 by means of two overrunning clutches 166 and 167 displaced angularly relative to one another on this shaft at 180° and operating in an antiphase relationship. When the lever 170 and the slider 165 rock, e.g. upwards, the drawbar 177 imparts to the overrunning clutch 167 a rotary motion to rotate the shaft 168, and the other drawbar 177 imparts a jamming motion to the overrunning clutch 166 at the same time, which is opposite to the direction of rotation of the clutch 167 and the intermediate shaft 168. When the lever 170 and the slider 165 rock downwards, the overrunning clutch 166 imparts rotary motion to the intermediate shaft, and the overrunning clutch 167 receives the opposite jamming motion from the drawbar 177 associated therewith.

The angle of rotation of the rubber-lined roll 141 (FIG. 15) and the rate of feed of warp threads which is determined thereby depend on the amount of displacement of the slider 165 together with the rocking lever 170.

By pulling the cable 134; the slider 165 is caused to move towards the sliding block 171 thereby diminishing the amplitude of oscillations of the slider 165, that is reducing the angular speed of the drive rubber-lined roll 141 and the rate of feed of the warp threads $A_1(A_2)$. When the tension of the cable 134 is reduced, the slider 165 is caused to move along the lever 170 in the opposite direction, and the rotary speed of the roll 141 and the rate of feed of the warp threads $A_1(A_2)$ increase.

In the mode of stitch formation the device 39 (FIGS. 13 and 15) transmits rotary motion from the shaft 180 to the rubber-lined roll 141 and ensures the feed of threads. Rotary motion is transmitted from the shaft 180 (FIG. 13), via the sliding key 187, drive clutch member 185, driven clutch member 184, to the drive rubber-lined roll 141. In this mode the lever 192 bears against the surface of the control drum 28, the cable 191 is relaxed, and the engagement of the clutch members 185 and 184 is ensured by the spring 188.

When the machine is switched over for knitting the welt 6 (FIG. 3) of a stocking, the drive rubber-lined roll 141 is disengaged and locked. For that purpose the control drum 28 (FIG. 13) rotates, the strap 193 engages the double-arm lever 192 to turn it, the cable 191 turns the fork lever 182, and the roller 190 urges the drive clutch member 185 away from the driven clutch member 184 so that the clutch members are disengaged, and the spring 188 is compressed. Transmission of rotary motion to the drive rubber-lined roll 141 is interrupted. At the same time, the arm 183 urges away the lever 194 which causes rotation of the cam 195 to bring closer the brake shoes 197 and 198 which are caused to engage and lock the driven clutch member 184 and the roll 141 in the inoperative position.

After the welt of a stocking is knit the strap 193 (FIG. 13) is caused to disengage from the double-arm lever 192 by rotating the control drum 28. The lever 192 removes the tension from the cable 191 to release the fork lever 182. The spring 188 expands to bring the drive clutch member 185 into engagement with the driven clutch member 184. At the same time, the fork lever 182 is turned by the clutch member 185, and the arm 183 releases the lever 194. The spring 200 causes the brake shoes 197 and 198 to move apart to release the driven clutch member 184 and the drive rubber-lined roll 141 so that they again can be caused to rotate. To provide for rapid engagement of the clutch members 184 and 185 at any relative position, they are made with fine teeth of triangular profile.

When the machine is switched over to the mode of knitting of the welt of a stocking (FIG. 1), the main rest 143 (FIG. 6) is retracted from the zone of engagement of the warp threads $A_1(A_2)$. For that purpose, the strap 162 of the control drum 28 engages the double-arm lever 161 to turn it, and the lever acts, via the cable 160, on the levers 159, 158 which cause the rotation of the rotatable spring-biased frame 151 by means of the drawbar 157 to retract the frame from the screw stops 154 and to expand the springs 153.

The adjustment screws 152 are thus retracted from the leaf springs 150 of the rest 143, and the arms 155 of the frame 151 lower down, with their stops 156, the rest 143 so that the warp threads of the outer set of the guide needles become controlled only by the additional spring-biased rest 147. At the same time, the drive rubber-lined roll 141 (FIG. 6) is stopped and locked, the guide needles 2 (FIG. 4) stop moving, and straight portions 17 are formed from the warp threads $A_1$ under the action of the general draw-off force which, as the welt 6 is knit, pulls the threads $A_1$ through the guide needles 2 thereby causing the additonal spring-biased rest 147 to move down (FIG. 6). The springs 149 apply a minimum force to the additional rest 147 which supports the warp threads $A_1$ passing around it at a low tension and does not hamper their movement to the stitch forming zone in the form of straight portions 17 (FIG. 4) at a rate of knitting of the welt 6.

After the welt 6 is knit, it is overturned. For that purpose, the control drum 28 (FIG. 6) rotates to disengage the strap 162 from the double-arm lever 161, the cable 160 is relaxed, and the springs 153 return the frame 151 back into the initial position until it bears against the screw stops 154. The levers 155 with the stops 156 are thereby retracted from the main rest 143, and the adjustment screws 152 of the frame 151 acting on the leaf springs 150 lift the main rest 143. Since the drive rubber-lined roll 141 is locked with its warp threads $A_1$ at that time, during the lifting of the main rest 143, this rest pulls the warp threads $A_1$ in the opposite direction through the guide needles 2 (FIG. 4) to shorten the straight portions and to thereby overturn the welt 6 (FIG. 5). The additional rest 147 is lifted by the springs 149 following the lifting of the main rest 143 (FIG. 6). After the welt of a stocking is overturned the feed of the warp threads $A_1$ is ensured by means of re-engaged drive rubber-lined roll 141 of the mechanism 26 for positive feed of warp threads.

During the overturning of the welt 6 (FIGS. 4–5) the general draw-off force F does not hamper the overturning since the action of the draw-off mechanism 27 on the hose is removed.

The drive shaft 117 of the draw-off mechanism 27 (FIG. 7) is permanently caused to rotate by the pulley 88 through the sleeve 84, gears 87, 110, 111, 112, intermediate shaft 113, worm gear 114, 115, and drive shaft 116. Rotary motion from the drive shaft 116 is transmitted, via the gears 123, 122, 121 and 120, to the shaft 119 of the driven fluted roll 118.

Figure 14:
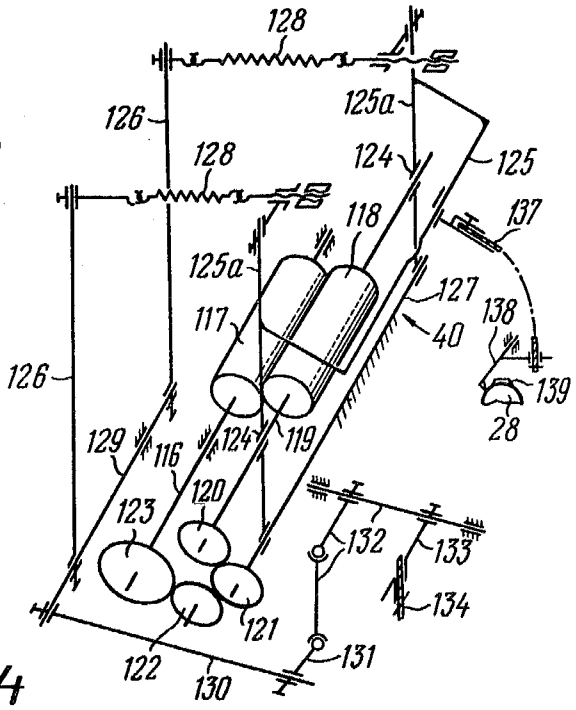
FIG. 14 is a kinematic chain diagram of the draw-off mechanism and device for spacing apart its rolls.

The draw-off mechanism (FIG. 7) is shown in detail in FIG. 14 where the image is turned with respect to the image of FIG. 7.

In knitting all portions of the stocking, except for overturning of the welt, the driven fluted roll 118 (FIG. 14) is urged against the drive fluted roll 117 and the drawn-off hose is inserted in the nip between both rolls. The driven fluted roll 118 is urged against the drive roll 117 by means of the arms 126 and springs 128 acting on both uprights **125*a* of the frame 125 which supports journal bearings of the roll 118. Linear velocity of the fluted rolls 117 and 118 is always greater than the linear velocity of the hose pulling, and the draw-off force depends on the force of friction between the fluted rolls and the surface of the hose, while the value of the friction force, hence the value of the general draw-off force is determined by the force at which the driven fluted roll 118 is urged against the drive roll 117. The amount of urging of the rolls against one another depends on the angle of rotation of the arms 126 which is set by means of the system of levers 133, 132, 131, 130 by the rotary shaft 129 supporting the arms 126. When the lever 133 is pulled up by the cable 134, the arms 126 are retracted from the rotatable frame 125 to expand the springs 128 and to increase the force urging the fluted rolls 118 and 117 against one another to increase the draw-off force acting on the hose. When the cable 134** is released, the draw-off force is reduced.

When the machine is switched over for overturning the welt, the control drum 28 rotates, and the strap 139 engages the double-arm lever 138 which, via the cable 137, cause the rotation of the frame 125 on the axle 127 to retract the driven fluted roll 118 from the drive fluted roll 117, and the continuous hose is released from the action of the draw-off mechanism. During rotation of the frame 125 the gear 120 rolls over the gear 121 and continues to transmit rotary motion to the shaft 119 and to the roll 118.

After the welt is overturned, the control drum 28 rotates, and the double-arm lever 138 is disengaged from the strap 139 to release, via the cable 137, the rotatable frame 125, and the springs 128 return the frame back to the initial position thereby providing a desired force for urging the driven fluted roll 118 against the drive fluted roll 117.

In knitting all portions of a stocking, except for overturning of the welt, the mechanism ensuring the movement of the knitting needles 1 (FIG. 1) and sinkers 19 receives the motion thereof from motion-imparting members 94 and 95 (FIG. 7) via kinematic chains of appropriate known type, and the mechanisms for positive feed of the warp threads $A_1$ and $A_2$ (FIG. 1), the racking and rocking mechanisms of the guide needles 2 and 3 are caused to move by the motion imparting member 96 (FIG. 7) via their branched kinematic chains of appropriate known type. The motion imparting members 94, 95, 96 are rotated together with the main shaft 36 which is caused to rotate by the pulley 88, via the sleeve 84, drive clutch member 89, driven clutch member 91 and sliding key 93. The driven clutch member 91 is held engaged with the drive clutch member 89 by the spring 106 (FIG. 16) which, via the lever 101, stop 105, lever 100, intermediate shaft 99, fork lever 98 and rollers 102 thereof, urges the clutch member 91 against the clutch member 89. The roller 107 engages the surface of the control drum 28.

To switch the machine over for overturning the welt, the control drum 28 rotates, and the strap 108 comes into engagement with the roller 107. The lever 101 is caused to rotate on the shaft 99 to compress, by the stop 109, the spring 104 which, via the cage 103, lever 100, intermediate shaft 99, fork lever 98 and rollers 102, causes the driven clutch member 91 to move along the main shaft 36 (FIG. 7) on the sliding key 93 toward the braking clutch member 90. The clutch member 91 will move until one cam 92 thereof bears against the end face of the braking clutch member 90. This cam 92 will then slide over the end face of the braking member 90, and the second cam 92 of the clutch member 91 is not disengaged from the drive clutch member 89 and transmits rotary motion from the clutch member 89 to the clutch member 91. When the cam 92 approaches the groove of the braking clutch 90, the spring 104 (FIG. 16) causes the driven clutch member 91 to move further so that one cam 92 thereof (FIG. 7) is received in the groove of the braking clutch member 90, and the other cam 92 leaves the groove of the drive clutch member 89. The braking clutch member 90 stops and locks the driven clutch member 91 in a fixed position, together with the main shaft 36 and all mechanisms associated therewith. The sleeve 84 transmits the motion to the control device of the machine and to the draw-off mechanism via the gears 86 and 87, respectively.

After the welt is overturned, the control drum 28 (FIG. 16) rotates, and the strap 108 is disengaged from the roller 107. The spring 106, via the lever 101, stop 105, lever 100, intermediate shaft 99 and the fork lever 98 with rollers 102, causes the driven clutch member 91 to move toward the driven clutch member 89 (FIG. 7) until the cam 92 approaches the end face of the clutch member 89. The braking clutch member 90 continue to lock the driven clutch member 91. When the groove of the drive clutch member 89 approaches the cam 92, the spring 106 causes the driven clutch member 91 to move further to bring it into engagement with the drive clutch member 89 and to disengage it from the braking clutch member 90. Motion is again imparted to the main shaft 36 and the mechanisms associated therewith.

Figure 15:
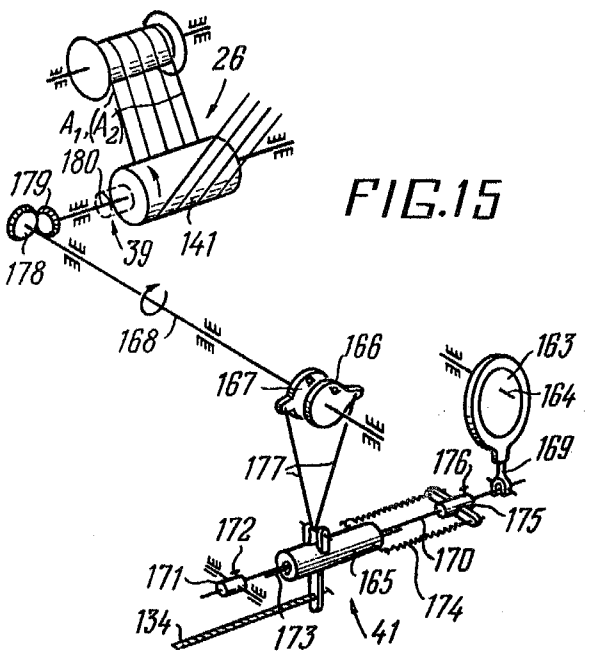
FIG. 15 is a kinematic chain diagram of the device for steplessly controlling the rate of feed of warp threads.
Figure 17:
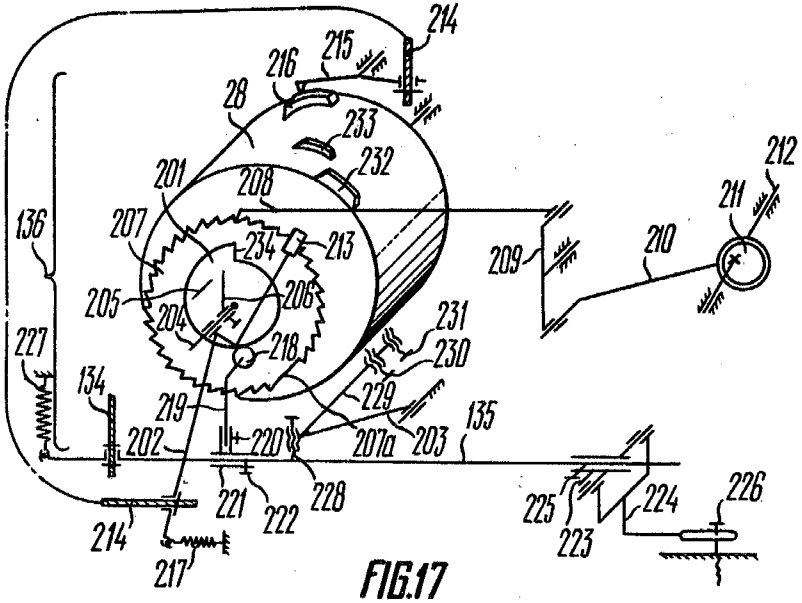
FIG. 17 is a kinematic chain diagram of the device controlling the change in the rate of feed of warp threads in accordance with a given program.

The perimeter of various portions of a stocking is changed by controlling the rate of feed of the warp threads $A_1$ and $A_2$ by means of the mechanism 41 (FIG. 15). The loop length and other parameters of the stitch pattern are thereby changed. The program for changing the rate of feed of warp threads in knitting various portions of a stocking is set by the control device 136 (FIG. 17). The position of the slider 165 (FIG. 15) on the lever 170 determines the position of the control lever 135 (FIG. 17) which is coupled to the slider 165 by means of the cable 134. The position of the control lever 135 is determined either by the cam 201 acting thereon through the roller 218, rod 219 and the sliding sleeve 221 fixed to the lever, or by the strap 232 or 233 acting on the lever 135 through the adjustment screws 230 or d 231, arm 229 secured to the lever 203 and adjustment screw 228. The control lever 135 is permanently biased by the spring 227 either against the cam 201 or against straps 223 or 233.

In knitting the tapering portion 9 (FIG. 2 ) of a stocking the cam 201 (FIG. 17) is caused to move together with the ratchet wheel 207 by the pawl 208 which is, in turn, caused to reciprocate via a kinematic chain including the lever 209, connecting rod 210 and eccentric 211, by the drive shaft 212. In order that the pawl 208 could engage the teeth of the ratchet wheel 207, the locking plate 213 is disengaged from the pawl 208 by the strap 216 of the control drum 28 acting, via the lever 215 and cable 214, on the double-arm lever 202. The roller 218 is acted upon by the profile of the cam 201 having ever increasing radius. The motion imparted by the cam 201 to the roller 218 is transmitted, via the rod 219, sliding sleeve 221, control lever 135 and cable 134, to the slider 165 (FIG. 15). The rotary speed of the drive rubber-lined roll 141 decreases as the roller 218 (FIG. 17) moves from the portion of the profile of the cam 201 of smaller radius to that of greater radius. The rate of feed of warp threads also decreases with respective reduction of loop length and perimeter of the courses of a stocking being knit.

Knitting of the instep 10 (FIG. 2) of a stocking is started when the toothless portion 207*a* of the ratcher wheel 207 engages the pawl 208 (FIG. 17). The roller 218 then engages the highest point of the cam 201 and takes the position $R_1$ (FIG. 18). The ratchet wheel 207 (FIG. 17) is stopped, as is the cam 201, and they remain stationary during the entire period of knitting of the instep portion 10, heel portion 11, sole portion 12 and boundary portion 14 of a stocking thus ensuring the feed of warp threads at minimum rate. Before the knitting of the sole 12 of a stocking is over, the pawl 218 (FIG. 17) is locked by the plate 213. For that purpose, the control drum 28 is rotated, the strap 216 disengaged the lever 215 and releases the cable 214, and the spring 217 turns the double-arm lever 202 so that the plate 213 engages the pawl 208.

By the end of knitting of the tor 12 (FIG. 2) the arm 206 (FIG. 17) closely approaches the pin 205.

When the machine is switched over for knitting the pull courses 13 (FIG. 2) of a stocking, the shaft 204 (FIG. 17) and the control drum 28 rotate so that the arm 206 acts on the pin 205 to rotate the cam 201 and the ratchet wheel 207, and the step 234 engages the roller 218 (FIG. 18). At the same time the strap 233 engages the screw 231 (FIG. 17). The spring 227 causes the control lever 135 to turn so as it tends to urge the roller 218 against the cam 201. The roller 218 does not reach the cam 201 and takes the position $R_2$ (FIG. 18) since the position of the control lever 135 (FIG. 17) is fixed by the strap 233, via the screw 231, arm 229, arm 203 and screw 228. when the roller moves from the position $R_1$ (FIG. 18) to the position $R_2$ , the control lever 135 (FIG. 17) is turned to release the cable 214 so that the device 14 (FIG. 15) can abruptly increase the rotary speed of the drive rubber-lined roll 14 of the mechanism for positive feed of warp threads and the length of loops. Since pawl 208 remains locked, the ratchet wheel 207 (FIG. 17) and the cam 201 also remain stationary during the knitting of the pull courses 13 (FIG. 2). The device 136 continues to operate also in knitting the portions 15 and 5 (FIG. 2) of a stocking.

When the machine is switched over for knitting the welt, the shaft 204 (FIG. 17) and the control drum 28 rotate so that the strap 232 engages the screw 230, and the strap 233 disengages the screw 231. Since the overturned welt of the warp knit stocking is knit with one-bar tricot stitch the rate of feed of warp threads is reduced compared to the rate used for the garterband portion 5 (FIG. 2). The shaft 204 (FIG. 17), via the arm 206 and pin 205, causes rotation of the cam 201 and ratchet wheel 207, and the roller 218 is in the position $R_3$ with respect to the profile of the cam 201 (FIG. 18). Concurrently with the switching over for knitting the welt, the cable 214 (FIG. 17) upon the command from the control device in a known per se manner causes rotation of the lever 202 to disengage the plate 213 from the pawl 208 and to ensure the engagement and rotation of the ratchet wheel 207, e.g. through three teeth per one stroke of the pawl 208. The ratchet wheel 207 strats moving together with the cam 201, but the rate of feed of warp threads remains unchanged and determined by the strap 232, via the members 230, 229, 203, 228, 135, 134 and the device 41 (FIG. 15). Angle of rotation (FIG. 17) of the ratchet wheel 207 and cam 201 is determined by the control device of the machine. When the portion of the cam 201 with the radius corresponding to the density of knitting, loop length and perimeter of the top portion of the leg of a stocking engages the roller 218, the control drum 28 is rotated to release the cable 214 so that the spring 217 turns the lever 202, and the plate 213 locks the pawl 208. The strap 232 is not disengaged from the screw 230, and the cam 201 ratchet wheel 207 are stopped. The roller 218 is in the position $R_3'$ (FIG. 18) with respect to the cam 201, and the welt knitting continues with the same loop length.

When the machine is switched over for knitting the leg, the control drum 28 (FIG. 17) is rotated, the strap 232 is disengaged from the screw 230, and the roller 218 engages the surface of the cam 201 in the position $R_4$ (FIG. 18). The device 41 (FIG. 15) sets-up the rate of feed of warp threads for the top portion 8 (FIG. 8) of the leg knit with two-bar tricot stitch.

Since the plate 213 (FIG. 17) continues to lock the pawl 208, the cam 201 and the control lever 135 remain stationary.

After this portion of the leg is knit, the cable 214 turns the lever 202 from the control device of the machine in a known per se manner, and the locking plate 213 is retracted so that the pawl 208 can engage and move the ratchet wheel 207, e.g. through two teeth. The cam 201 starts moving. Upon each angular motion of the ratchet wheel 207 the cam 201 smoothly turns the control lever 135 and acts, via the cable 134, on the device 41 (FIG. 15) which steplessly controls the rate of feed of warp threads. The tapered portion 9 (FIG. 2) is knit. By controlling the plate 213 several tapering portions may be made on the leg 7 of a stocking.

The amount of taper may be varied by displacing the control lever 135 (FIG. 17) on the sliding block 223 concurrently with or without the adjustment of the position of the arm 224 with respect to the machine frame. Correct positioning of the roller 218 with respect to the cam 201 is achieved by displacing the sliding sleeve 221 relative to the control lever 135.

Concurrently with an increase or decrease in the rate of feed of warp threads to change the loop length, the general draw-off force should be also increased or decreased by the draw-off mechanism 27 (FIG. 7). For that purpose, the draw-off mechanism 27 is coupled, e.g. by the same cable 134 (FIG. 14) to the device 136 for controlling the loop length, so that the force urging the fluted draw-off rolls 118 and 117 (FIG. 14) is changed synchronously with the change in the rate of feed of the warp threads, thereby changing the draw-off force applied to the continuous hose being knit.

When the machine is switched over from knitting the instep portion 10 (FIG. 2) of the stocking 4*a* for knitting the heel portion 11, the knitting needles 1 arranged along a portion of perimeter of the needle cylinder are regularly disengaged (e.g. every two complete annular courses) by means of any appropriate known mechanism, and the knitting needles which remain engaged knit additional courses (e.g. two courses) with two-bar tricot stitch. As a result, shorter additional courses forming the heel of the stocking are inserted inbetween complete annular courses.

What is claimed is:

1. A method for knitting stockings on a circular warp knitting machine, comprising: laying two systems of warp threads on knitting needles of the machine by means of two sets of guide needles which are caused to move along the front of and between the knitting needles; knitting a continuous hose consisting of a plurality of stockings of given length from said systems of warp threads under the action of a general draw-off force; each stocking of said continuous hose being made by knitting in a sequence, an overturned welt with one bar tricot stitch from one system of warp threads, and a cylindrical portion of the leg, a tapering portion, an instep, a heel portion, a sole with a tubular toe and pull courses with two-bar tricot stitch from the two systems of warp threads; knitting, in each stocking, after the pull courses are knit, a garterband portion with two-bar tricot stitch from the two systems of warp threads, with the loop length at least equal to the loop length of the cylindrical portion of the leg; knitting between said sole portion and said pull courses at least two courses with one-bar tricot stitch from one system of warp threads to form a boundary portion of the pull courses; knitting between said pull courses and said garterband portion two courses with one-bar tricot stitch from one system of warp threads to form a boundary portion of said tubular toe; maintaining, in knitting said welt and said boundary portions of said pull courses and said tubular toe of a stocking from one system of warp threads, the feed of warp threads of the second system to the stitch forming zone and the action of the general draw-off force; cutting said continuous hose into individual stockings across said boundary portions; and closing the toe in each stocking in a known per se manner.

2. A method according to claim 1, wherein, in knitting the welt of a stocking from one system of warp threads, the rate of feed of warp threads of the other system is set to be equal to the rate of knitting of the welt; removing the action of the general draw-off force after a given length of the welt is knit, with concurrent drawing-off of the warp threads of the second system in the direction opposite to the feed thereof, whereby the first course of the welt is brought to the ultimate course thereof to overturn the welt; applying the general draw-off force to the stocking again after said overturning of the welt and, by laying the warp threads of both systems together on the knitting needles, sewing-up the welt to form the first course of said leg, all stitch forming members being disengaged during the overturning of the welt.

3. A method according to claim 1, wherein, concurrently with the switching-over for the knitting of the pull courses of a stocking, the rate of feed of warp threads of both systems is increased to form loops of the pull courses of a length equal to the length of the loops of the garterband portion.

4. A circular warp knitting machine comprising: a needle cylinder having movable knitting needles and sinkers; two systems of warp threads; mechanisms for positive feed of warp threads of each system; two sets of guide needles which are caused to move between the knitting needles; rocking mechanisms providing said movement of the guide needles between the knitting needles; two concentrically arranged guide bars which are caused to move along the front of the knitting needles and which accommodate said sets of guide needles; racking mechanisms designed to cause the movement of said annular guide bars, one of the racking mechanisms being adapted to disengage its annular guide bar for knitting the welt of a stocking with one-bar tricot stitch from warp threads passing through the guide needles of another guide bar; a control drum for controlling mechanisms of the machine; mechanisms for positive feed of warp threads of each system having drive rubber-lined rolls, each of said mechanisms for positive feed of warp threads having a spring-biased rest and a device for steplessly controlling the rate of feed of warp threads which is kinematically coupled to said control drum; one of said mechanisms for positive feed of warp threads passing through the set of guide needles which is disengaged being provided with an additional spring-biased rest, the main spring-biased rest thereof being retractile from the zone of engagement with the warp threads; means for retracting the main spring-biased rest from the zone of engagement with the warp threads; a draw-off mechanism having a device for spacing apart the rolls thereof and for steplessly controlling their urging force which is kinematically coupled to the control drum; a main shaft imparting motion to stitch forming members—knitting needles, sinkers, two sets of guide needles, mechanisms for positive feed of warp threads; a stop motion of said main shaft for disengaging the stitch forming members during the overturning of the welt; stop motions of said racking and rocking mechanisms of one of said sets of guide needles; a stop motion for stopping the mechanism for positive feed of warp threads passing through the set of guide needles which is disengaged, whereby portions of a stocking are knit with one-bar tricot stitch from the warp threads passing through the other set of guide needles which is engaged; said stop motions being kinematically coupled to said control drum; said devices for steplessly controlling the rate of feed of warp threads being kinematically coupled to said control drum; means for causing the knitting needles and the sinkers to move; a drive for rotating said control drum and said main shaft.

5. A machine according to claim 4, wherein said stop motion of said rocking mechanism of one of the sets of guide needles comprises: a drive shaft of the machine; a sleeve which supports a motion imparting member of said rocking mechanism and is loosely mounted on said drive shaft of the machine; a cam clutch having a drive clutch member secured to the drive shaft of the machine, a braking member rigidly secured to the machine frame coaxially with said drive shaft, and a double-action driven clutch member mounted on said sleeve by means of a sliding key for moving along said sleeve and for alternately engaging the drive clutch member or the braking member; said kinematic coupling of the stop motion of the rocking mechanism to the control drum comprising: intermediate links; a fork lever embracing the driven clutch member and secured to the machine frame; two telescoping rods urged by springs against one another, one rod being connected to said fork lever and the other rod being urged by a spring against the machine frame and coupled by means of said intermediate links to said control drum.

6. A machine according to claim 4, wherein said stop motion of the racking mechanism comprises: a ring kinematically coupled to said control drum; a boss secured to the outer periphery of said ring; an arm secured to said ring; each racking mechanism comprising: a drive shaft to which is secured a plate and on which is rotatably mounted said ring; a profiled cam mounted on the plate of the drive shaft; a roller elastically urged against said profiled cam; a double-arm lever supporting said roller and linked, by means of a drawbar, to said guide bar; the radius of the outer surface of said boss being equal to the maximum radius of said profiled cam, and upon rotation of the ring said boss engages said roller to keep it retracted from the profiled cam.

7. A machine according to claim 4, wherein, in the mechanism for positive feed of warp threads, said additional spring-biased rest is installed in a close proximity of said main spring-biased rest and on the same axle therewith; said means for retracting the main rest from the zone of engagement with the warp threads comprises: a rotatable spring-biased frame which supports arms and is installed on the common axles of both rests; leaf springs coupling the main rest to said rotatable spring-biased frame, the arms of the frame acting on the main rest upon rotation of the frame; a system of levers coupling said rotatable frame to said control drum.

8. A machine according to claim 4, wherein said device for steplessly controlling the rate of feed of warp threads comprises: a drive shaft; an eccentric on the drive shaft; a lever mounted in the machine frame and linked to said eccentric; a device controlling the change in the rate of feed of warp threads in accordance with a given program; a spring-biased slider mounted on said lever and kinematically coupled to said control drum and said device for controlling the change in the rate of feed of warp threads in accordance with a given program; an intermediate shaft kinematically coupled to the shaft of the drive rubber-lined rolls of the mechanism for positive feed of warp threads, the shafts of the rubber-lined rolls being coupled to said drive rolls by their stop motions; two overrunning clutches angularly displaced relative to one another at 180° which are linked by means of drawbars to said slider and installed on said intermediate shaft.

9. A machine according to claim 8, wherein the stop motion of the mechanism for positive feed of warp threads comprises, for each drive rubber-lined roll: a fine-tooth clutch having a driven clutch member secured to the drive rubber-lined roll and a drive clutch member having an annular groove, installed on the shaft of the drive rubber-lined roll by means of a sliding key and urged by a spring against the driven clutch member; a fork lever kinematically coupled to said control drum and having rollers received in the annular groove of the drive clutch member, and an arm; a lever cooperating with the arm of the fork lever and having a cam; brake shoes embracing the driven clutch member and coupled to said lever by means of the cam.

10. A machine according to claim 8, wherein said device controlling the change in the rate of feed of warp threads in accordance with a given program comprises a cam loosely mounted on the shaft of said control drum; an arm secured to the shaft of the control drum; a pin mounted on the end face of said cam and engaging said arm; a ratchet-and-pawl mechanism having a ratchet wheel rigidly connected to said cam; a spring-biased control lever which has a with a roller engaging the cam and is coupled by means of a flexible link to the spring-biased slider of said device for steplessly controlling the rate of feed of warp threads; a double arm lever having one arm which is coupled, via an intermediate member, to the control drum and the other arm which has a plate locking the pawl of the ratchet-and-pawl mechanism; an arm supported by said spring-biased control lever and engaging said control drum.

11. A machine according to claim 4, wherein the device for spacing apart the rolls of the draw-off mechanism and for steplessly controlling their urging force comprises: a rotatable frame supporting the drive roll of the draw-off mechanism; intermediate links coupling said rotatable frame to said control drum; a rotatable shaft supporting two arms and coupled, via other arm and a system of levers, to said control lever of the device controlling the change in the rate of feed of warp threads in accordance with a given program; springs coupling said rotatable frame to the two arms of said rotatable shaft.

12. A machine according to claim 4, wherein said stop motion of the main shaft comprises: a sleeve loosely mounted on the main shaft and supporting a machine drive pulley; a double-action cam clutch having a drive clutch member secured to the sleeve, a braking member secured to the machine frame coaxially with the main shaft, and a driven clutch member mounted on the main shaft by means of a sliding key for moving therealong and for alternately engaging the drive clutch member or the braking member; gears transmitting motion to the draw-off mechanism and to the control device of the machine, secured to said sleeve; the driven clutch member being coupled, via a fork with a roller, an intermediate shaft and a system of levers interconnected by springs, to said control drum of the control device of the machine.

* * * * *